US009879433B2

(12) United States Patent
Mann

(10) Patent No.: US 9,879,433 B2
(45) Date of Patent: Jan. 30, 2018

(54) SUSPENSION RAILS FOR PANEL VENEER SYSTEMS

(71) Applicant: Matthew Mann, Peterstown, WV (US)

(72) Inventor: Matthew Mann, Peterstown, WV (US)

(73) Assignee: Matthew Mann, Peterstown, WV (US)

( * ) Notice: Subject to any disclaimer, the term of this patent is extended or adjusted under 35 U.S.C. 154(b) by 0 days.

(21) Appl. No.: 15/049,626

(22) Filed: Feb. 22, 2016

(65) Prior Publication Data

US 2016/0168862 A1 Jun. 16, 2016

Related U.S. Application Data

(60) Division of application No. 14/665,224, filed on Mar. 23, 2015, now Pat. No. 9,267,295, which is a continuation-in-part of application No. 13/918,017, filed on Jun. 14, 2013, now Pat. No. 8,997,423, which is a continuation-in-part of application No. 13/179,831, filed on Jul. 11, 2011, now Pat. No. 8,806,826.

(60) Provisional application No. 61/362,740, filed on Jul. 9, 2010, provisional application No. 61/486,850, filed on May 17, 2011.

(51) Int. Cl.

| | |
|---|---|
| ***E04F 13/08*** | (2006.01) |
| ***E04C 2/38*** | (2006.01) |
| *E04C 3/04* | (2006.01) |

(52) U.S. Cl.

CPC ..... *E04F 13/0803* (2013.01); *E04C 2/38* (2013.01); *E04F 13/0805* (2013.01); *E04F 13/0816* (2013.01); *E04F 13/0846* (2013.01); *E04F 13/0873* (2013.01); *E04C 2003/046* (2013.01); *E04C 2003/0434* (2013.01); *E04F 2203/02* (2013.01)

(58) Field of Classification Search

None

See application file for complete search history.

(56) References Cited

U.S. PATENT DOCUMENTS 3,353,312 A * 11/1967 Storch ..... E04F 13/0846 52/508

3,453,795 A * 7/1969 Heirich ..... E04F 13/0805 52/479

(Continued)

*Primary Examiner* — Brian Glessner

*Assistant Examiner* — Adam Barlow

(74) *Attorney, Agent, or Firm* — New River Valley IP Law, PC; Michele L. Mayberry

(57) ABSTRACT

The present invention relates to the field of mortarless, brick- and stone-like veneer systems for walls. More particularly, the present invention relates to suspension rails for providing mortarless or mortar-optional installations of brick- and stone-like panels for covering walls. Embodiments of the invention provide a cage-type suspension rail configured to be partially embedded in the panel and a universal hanging bracket that provides pullout resistance for the panels. An exemplary suspension rail comprises: a first four-sided frame with horizontally and vertically disposed sides; a plurality of posts disposed on and perpendicular to the first frame or the cross bars; a second four-sided frame in communication with the plurality of posts; an upper tab in communication with the first frame for connecting the rail to a surface; wherein the upper tab is disposed outside a perimeter of the first frame and a perimeter of a second frame.

13 Claims, 20 Drawing Sheets

(56) References Cited

U.S. PATENT DOCUMENTS

| | | | | | |
|---|---|---|---|---|---|
| 3,958,384 | A * | 5/1976 | Megumi | E04F 13/141 | 52/266 |
| 4,553,366 | A * | 11/1985 | Guerin | E04F 13/0803 | 52/506.08 |
| 5,010,705 | A * | 4/1991 | Akihama | B28B 23/00 | 52/235 |
| 5,337,530 | A * | 8/1994 | Beames | E04B 2/8652 | 52/426 |
| 5,893,245 | A * | 4/1999 | Sekiguchi | E04F 13/0816 | 403/295 |
| 6,170,214 | B1 * | 1/2001 | Treister | E04F 13/0808 | 52/235 |
| 8,336,264 | B2 * | 12/2012 | Sato | F24J 2/0444 | 52/173.3 |
| 8,359,811 | B2 * | 1/2013 | Muller | E04F 13/144 | 52/477 |
| 8,769,901 | B2 * | 7/2014 | Todd | E04F 13/0805 | 52/302.1 |
| 2004/0060256 | A1 * | 4/2004 | Frascari | E04F 13/0819 | 52/698 |
| 2009/0038260 | A1 * | 2/2009 | Michel | E04F 13/18 | 52/782.1 |
| 2010/0011688 | A1 * | 1/2010 | Moran | E04F 13/0803 | 52/250 |

* cited by examiner

SUSPENSION RAILS FOR PANEL VENEER SYSTEMS

CROSS-REFERENCE TO RELATED APPLICATIONS

The present application claims priority to and is a Divisional of U.S. patent application Ser. No. 14/665,224 filed Mar. 23, 2015, which application is a Continuation-in-Part (CIP) of U.S. patent application Ser. No. 13/918,017 filed Jun. 14, 2013 (issued as U.S. Pat. No. 8,997,423 on Apr. 7, 2015), which application is a Continuation-in-Part (CIP) of parent application U.S. application Ser. No. 13/179,831 filed Jul. 11, 2011 (issued as U.S. Pat. No. 8,806,826 on Aug. 19, 2014), and which parent application claims priority to and the benefit of the filing date of U.S. Provisional Application Nos. 61/362,740 and 61/486,850 filed on Jul. 9, 2010 and May 17, 2011, respectively. All of these applications are incorporated herein by reference in their entireties.

BACKGROUND OF THE INVENTION

Field of the Invention

The present invention relates to the field of brick or stone-like veneer systems for walls. More particularly, the present invention relates to suspension rails for use in mortarless or mortar-optional brick or stone-like veneer systems. The suspension rails include a cage-type suspension rail and a universal bracket that resists pull-out of the brick or stone-like veneers.

Description of Related Art

Conventional mortar-based facade systems, including brick and stone are as difficult to remove as they are to install. Although the strength of a mortar-based system is generally an advantageous feature, such systems are susceptible to a number of disadvantages. For example, installation of brick and stone using mortar requires favorable weather and temperature conditions to be sure the mortar sets properly. This limits installation, especially in areas where seasonal changes occur, to relatively dry and ambient conditions.

In contrast, modular mortarless systems can be installed year round regardless of external weather conditions. Likewise, modular systems have the advantage of ease of installation, not requiring special skills and so can be installed by a range of installers, from the do-it-yourself to the trained stone mason. Even further, mortarless systems because they do not have to be adhered to the entire surface area of a wall can provide better ventilation and moisture removal than conventional mortar-based veneers.

Existing mortarless systems, such as those disclosed in U.S. Pat. No. 8,322,103 entitled "Faux Brick with Suspension System," use one or more suspension rails to retain a panel resembling an arrangement of one or more bricks. To affix the panels to a wall, the top and bottom edges of the panels are retained in a track of a separate, non-embedded suspension rail. Such a system is vulnerable to pull out from the wall during extreme weather conditions (such as high winds) due to the rail and the panel being separate pieces.

Another existing mortarless system is disclosed in U.S. Pat. No. 7,841,147 entitled "Mortarless Facade System." A system described in this patent uses a suspension rail with a two semicircular loops, which during fabrication are embedded into the panels. The panels are then secured to a wall using a fastening device or adhesive to secure the suspension rail and thus the panel to the wall. In an embodiment, the panel has a convex rounded upper edge and a corresponding concave rounded lower edge for mating with upper and lower panels of the system. The system provides two suspension rails for each panel, with only a portion of each rail embedded in the panel, along only two sides of the panel. Such a design is susceptible to failure due to only a small portion of the panel being supported by the suspension rail. An example of securing a wall panel with clips is disclosed in U.S. Pat. No. 7,926,237. Both of these patents are hereby incorporated by reference herein in their entireties.

Additionally, existing mortarless systems, do not have the advantage of strength to resist pullout of the modular panels. Modular mortarless systems are usually configured for convenience of manufacture at the expense of strength and aesthetic appeal. For example, there is usually minimal overlap, if any, between the panels of existing modular systems. With no overlap between the tiles, it is relatively easy to insert a tool between the panels and pry them away from the wall on which they are installed. Likewise, with readily apparent joints or seams between panels, it is usually instantly recognized that the system is a facade. Compounding the issue is that for ease of manufacture the panels are usually configured as a single universal shape panel. When panels of the same size and shape are installed together in a system it is typically quite easy upon visual inspection to identify the outline of each panel.

What is desired is a facade that has the appearance and strength of a stone and mortar or brick and mortar installation, but which is cost effective to manufacture and install. Ease of installation is also a plus without compromising on aesthetic appeal. Thus, what is needed is a modular, preferably non-mortar system that addresses the disadvantages of conventional mortar-based systems, but has the strength, ease of installation, and aesthetic appeal of and aesthetic similarity to these conventional systems.

SUMMARY OF THE INVENTION

To address these issues, embodiments of the present invention provide suspension rails whether embedded or stand alone, for use in mortarless or mortar-optional veneer systems comprising a plurality of panels. Also included within the scope of the invention are the panels themselves, the as well as methods of making the panels and methods of using the systems of the invention.

Embodiments of the invention provide a cage-type suspension rail configured to be partially embedded in the panel comprising: a first four-sided frame with horizontally and vertically disposed sides; a plurality of posts disposed on and perpendicular to the first frame or the cross bars; a second four-sided frame in communication with the plurality of posts; an upper tab in communication with the first frame for connecting the rail to a surface; wherein the upper tab is disposed outside a perimeter of the first frame and a perimeter of a second frame. In embodiments, the perimeter of the first frame is larger than the perimeter of the second frame. In embodiments, the upper tab is in direct communication with the first frame but not the second frame. Embodiments may further comprise one or more side tabs disposed perpendicular to a vertical side of the first frame and parallel to the plurality of posts or one or more cross bars joining two or more sides of the first frame.

Preferred are such facade panels, wherein the tab comprises one or more void. The void is preferably configured to receive a fastener to fix the suspension rail and thus the stone-like or brick-like panel to a wall. Any number of voids can be used.

In embodiments, the tab for fixing the suspension rail to a surface can be disposed completely or partially along a side of the first frame. Preferred is such a facade panel, wherein the tab is disposed completely along a side of the first frame and is in a stepped configuration with respect to that side of the first frame.

A plurality of voids may also be disposed along a side of the first frame opposing the side of the first frame with the tab. Having voids on both the upper and lower edges of the suspension rail will allow for easy alignment of the panels on a wall by aligning the voids on the tab of one suspension rail with the voids along the lower edge of another suspension rail.

In preferred embodiments, the facade panel includes a tab with a spacing and/or directional indicator. When installing the panels on a wall, this indicator can be used to align panels in a second row disposed at a desired position relative to panels in a first row.

In embodiments, one or more cross bar of the suspension rail is disposed at an angle less than perpendicular to any of the four sides of the first frame. The one or more cross bat may be disposed in an X configuration. The one or more cross bar may be disposed perpendicular to any of the four sides of the first frame and may be fortified with a perpendicular support. The four sides of the first frame may have a width greater than their thickness and the four sides of the second frame may have a thickness greater than their width.

Side tabs can also be incorporated into the suspension rail embodiments. Such side tabs are useful for ensuring proper spacing between panels in each row. For example, the panel can comprise side tabs disposed perpendicular to opposing sides of the first frame and on sides perpendicular to the side with the tab. This ensures that during installation one panel is spaced a desired amount away from another panel in a row by abutting the side tab of one suspension rail against a corresponding tab of the suspension rail of another panel.

The sides of the first frame can have a width greater than their thickness and the sides of the second frame can have a thickness greater than their width. With the first frame wider than it is thick, this provides for a substantially planar face, which is helpful for a secure connection with a wall by being supportive over a large planar area of the wall. The suspension rail can also have a rippled surface on the face that is intended to abut the wall. Such a rippled surface may provide for additional support and/or for ventilation between the wall and rail.

In embodiments, the facade panel can have a perimeter of the first frame that is larger than a perimeter of the second frame. In this manner, when embedded in the panel, the second frame will be completely embedded in the material and not be exposed. Preferred is a suspension rail where the second frame is entirely embedded in the molded panel and wherein the posts are partially embedded in the molded panel to provide for a gap between the first frame and the molded panel. Also preferred are such suspension rails that are 3-D printed.

Embodiments of the invention provide a cage-type suspension rail configured to be partially embedded in the panel comprising: a first support member with a planar face having a first support member perimeter; a plurality of posts each with a first end disposed on and perpendicular to the first support member; a second support member disposed in communication with the plurality of posts at a second end of each post; a tab in communication with the first support member and having a planar face disposed in a stepped configuration relative to the planar face of the first support member, such that an outline of the faces of the first support member and the tab define a perimeter of the suspension rail, which perimeter is larger than a perimeter of the first support member.

Embodiments include a suspension rail wherein the first support member and the second support members are configured as four-sided frames. In embodiments, the perimeter of the suspension rail is larger than a perimeter of the second support member. In embodiments, the second support member is disposed perpendicular to the posts and disposed parallel to the first support member. In embodiments, the suspension rails may further comprise one or more side tabs disposed perpendicular to one or more sides of the first support member or one or more cross bars disposed in an X configuration.

In addition to cage-type suspension rails, embodiments of the invention may additionally include suspension rails that serve as universal brackets for hanging a brick- or stone-like panel that resist pullout of the panels. The suspension rails can comprise an elongated planar member, an upper and lower mounting bar, and means for receiving securing means for connecting the suspension rail to a substrate surface. Panels and facade system embodiments of the invention need not comprise a suspension rail with a particular configuration nor comprise all of these functionalities, however, preferred embodiments include the inventive suspension rails as well.

Receiving means for the securing means that is incorporated into the universal bracket can be of any configuration. For example, the suspension rail can comprise an elongated v-shaped groove disposed lengthwise below the upper mounting bar for receiving screws at any point along the width/length of the suspension rail. Holes, whether circular or oblong, can alternatively be included to receive screws and can be disposed at various points along the length of the suspension rail.

Ideally, the suspension rail has some flexibility incorporated into its structure or is comprised of a material that allows for flexing or bending or one or both of the mounting bars. Such functionality can include structure in the form of a c-shaped groove along the length of the suspension rail to which the mounting bar is in communication with. The c-shaped channel allows for the mounting bar to be flexed toward or away from the body of the suspension rail to allow for ease of insertion of the mounting bar into a facade system on installation.

Feet for embedding or attaching the suspension rail to the back side of a facade panel can also be incorporated into the suspension rail. The feet can be disposed at any angle relative to the body of the suspension rail, however, a perpendicular position is preferred. Additionally, it is preferred to connect the panel with the suspension rail in a manner to provide an air gap between the facade panel and the elongated planar member. The air gap will allow for any moisture that collects behind the panels to drain away from the system and not interfere with the connection between the panels and the wall surface after installation.

Embodiments of the invention include a suspension rail serving as a universal bracket which comprises: an elongated planar member with upper and lower longitudinal edges, upper and lower c-shaped channels disposed along and formed in part by the longitudinal edges of the planar member, one or more feet in communication with the planar member or the upper or lower c-shaped channel and disposed perpendicular thereto, a v-shaped groove disposed lengthwise along and in communication with the upper c-shaped channel, an upper planar mounting bar disposed lengthwise along and in communication with the v-shaped groove and parallel to the planar member, and a lower planar mounting bar disposed lengthwise along and in communication with the lower c-shaped channel and disposed at an angle in the range of about 135 to 180 degrees relative to the planar member. In embodiments, the upper planar mounting bar is disposed in a plane spaced a greater perpendicular distance from the elongated planar member than a longitudinal edge of the lower planar mounting bar. In embodiments, during use a surface of the upper mounting bar of a suspension rail of one panel in a facade system is capable of overlapping with a surface of the lower mounting bar of a suspension rail of another panel in the facade system.

Included in embodiments of the invention are panel veneer systems comprising at least two universal brackets for providing support against pullout of the panels. Each universal bracket (otherwise referred to as a suspension rail) can provide a surface for engaging another panel or for engaging with a corresponding bracket of another panel. Preferably, each bracket comprises an engagement surface substantially along the length of one side of the panel, or a major part of the length thereof, such as 50% or more. The brackets can also be configured to be a single piece providing one or more, typically two, additional engagement surfaces. Preferably, the bracket(s) are embedded in the panels during the manufacturing process or prior to installation to provide easy to install panels. The brackets, together with the length of the engagement surfaces provided by the panels themselves, can provide a total engaging length of 50% or more of the perimeter of the panel and up to 150% of the perimeter, or any engagement length between. Preferably, panels of the system with integral bracket(s) engage 100% to 150% of perimeter length.

Embodiments of the invention also include, among other things, facade systems, panels for facade systems, and brackets for hanging panels in a system. In certain embodiments, the panels preferably comprise one or more surfaces for engaging or overlapping other panels in the system.

Facade panels of this invention encompass modular facade panels comprising: (i) a front face for forming part of a first facade, wherein the face is formed as a plurality of stacked stones and has a concave rectilinear polygonal outline configured for mating with adjacent panels when installed in a facade system; (ii) a back side with a suspension rail in communication therewith; and (iii) left and right sides for forming part of another facade in a different plane.

Embodiments of the invention may also include suspension rails with any combination of features described herein.

The suspension rails of the invention are useful for mortarless or mortar-optional mounting of panels, including brick or brick-like, stone or stone-like, or other suitable veneer. As components of veneer systems, the suspension rails provide for strength and ease of installation of panels that have an aesthetic appeal similar to traditional mortar-based brick or stone systems.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described preferred embodiments of the invention. The features and advantages of the present invention will be apparent to those skilled in the art. While numerous changes may be made by those skilled in the art, such changes are within the spirit of the invention.

BRIEF DESCRIPTION OF THE DRAWINGS

The accompanying drawings illustrate certain aspects of some embodiments of the present invention, and should not be used to limit or define the invention. Together with the written description the drawings serve to explain certain principles of the invention.

DETAILED DESCRIPTION OF VARIOUS EMBODIMENTS OF THE INVENTION

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

Veneer System with L-shaped Clip

Figure 1:
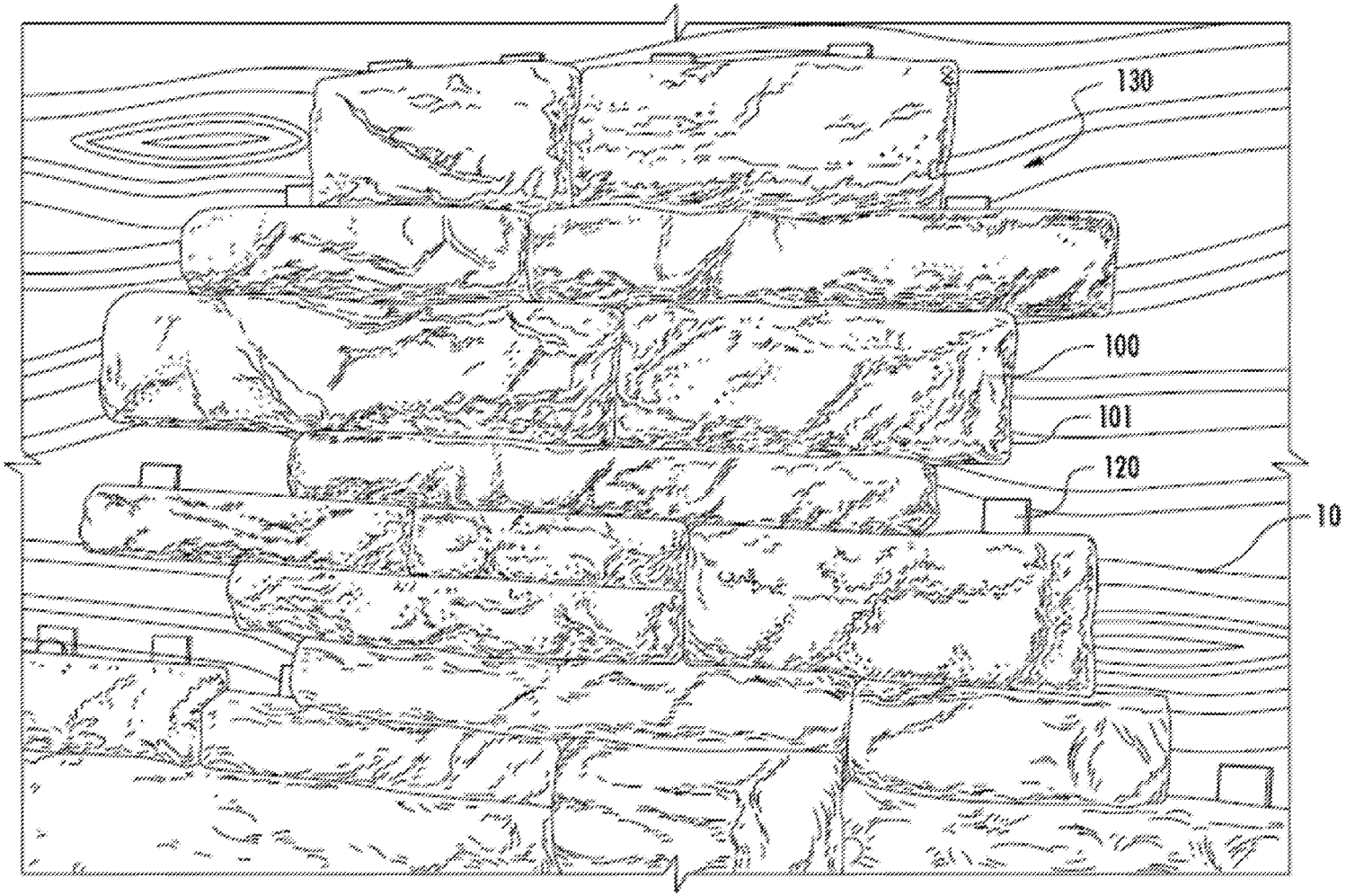
FIG. 1 is a schematic drawing showing a front perspective view of an embodiment of an exemplary facade system of the invention comprising panels of single stones each with an embedded L-shaped suspension rail or clip, where the plurality of stones is arranged to cover a portion of a wall.

Facade panels, suspension rails for supporting facade panels, and facade systems incorporating such facade panels and suspension rails are included within the scope of the invention. Provided is a veneer system comprising a plurality of facade panels each with one or more embedded suspension rails. As shown in FIG. 1, a facade system 130 of the invention can comprise one or more panels 100. Each panel is configured to represent a single stone or brick (or may represent multiple stacked stones or bricks) and each panel comprises one or more suspension rails, such as an L-shaped suspension rail or clip 120, preferably embedded in the rear face 101 of the panel 100. When installed on a substrate surface 10, the rear face 101 of the panel 100 faces substrate surface 10. Here, the substrate shown is a piece of plywood, but can be any material such as drywall, cement, hardy board, fiber board, etc. FIG. 1 shows that systems 130 can have a a plurality of panels 100 and can preferably be arranged to cover a wall or a portion of a wall 10.

L-shaped Clip

Figure 2A:
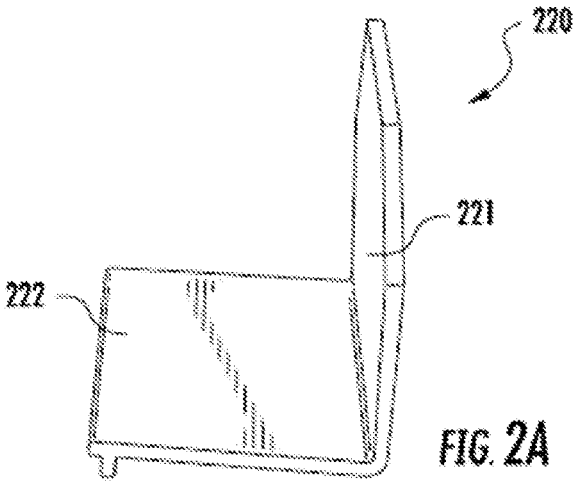
FIGS. 2A-C are schematic drawings illustrating an exemplary L-shaped clip.
Figure 2B:
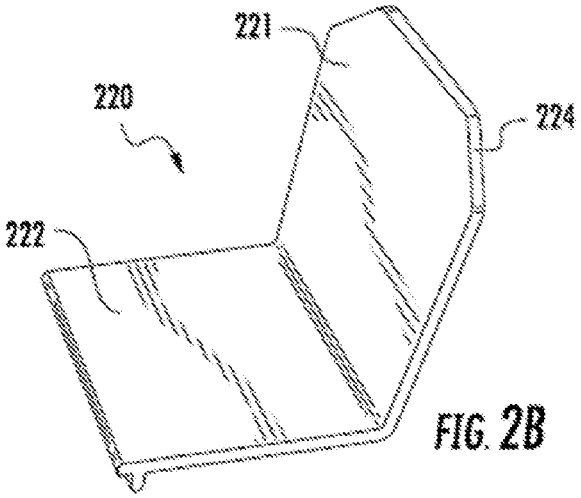
Figure 2C:
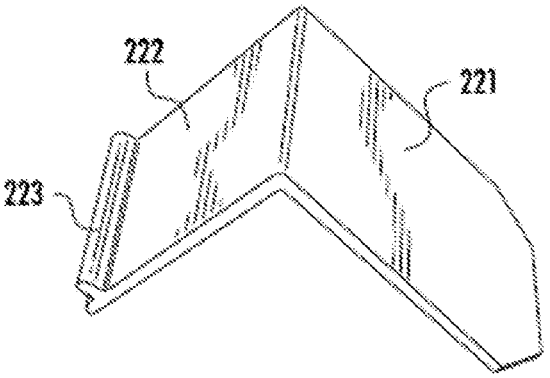

FIGS. 2A-C are schematic drawings illustrating an exemplary L-shaped clip 220 (otherwise referred to as an L-clip) that can be used in embodiments of the invention. In the context of this specification, the terms clip and suspension rail may be used interchangeably to refer to an embedded support for a panel of the system. In embodiments, at least a portion of the clip or suspension rail 220 is embedded in the rear face of the panel (the side of the panel that faces the wall when installed as a facade system). The L-shaped clip or suspension rail 220 is preferably made of plastic or a composite material and can be quickly and easily fabricated using a traditional plastic manufacturing techniques, including by injection molding, thermoforming, or even using a silicon, composite, or polyurethane molding process, or a 3-D printing machine. The L-clip 220 can be fabricated from composite or metal materials. The typical thickness of the L-clip is between 0.1 and 0.5 inches. The L-clip provides a first planar attachment member 221 and a second planar embedding member 222, where the two planar members 221, 222 are disposed relative to one another at substantially a right angle. In this specification, the planar members 221, 222 may also be referred to as a planar surfaces. Each of these components may be molded, carved or shaped individually and then attached together to form the L-clip, or the L-clip can comprise a single, seamless piece of material which is shaped to reflect these distinct sections. If metal or plastic is used as the L-clip, a single piece of material can be provided and then folded into the desired L-shaped configuration.

As shown in FIGS. 2A-C, the second planar embedding member 222 can comprise one or more protrusions 223 along an edge. The second planar embedding member 222 is the portion of the clip 220 that is embedded into the panel. The protrusion 223 may be elongated and may be disposed on the first planar member completely or partially along the width of the clip and can have a cross section of any shape. The protrusion on the first planar member should be shaped and sized to resist pull out from the panel when the first planar member is embedded therein. In preferred embodiments, the protrusion is elongated with a cross section of a curvilinear or rectilinear polygon disposed approximately perpendicular to the planar surface. The thickness of the protrusion is approximately the same as that of the first planar member. Each side of the first planar member typically has a length between 0.5-3 inches and all sides are approximately equal to one another in length. It is not critical how wide, thick, or long the first or second planar members are and these features may be desiged accordingly for a particular type of panel. Generally, the greater the dimensions, the greater the support provided to the panel, so a larger panel may benefit more from a larger L-shaped clip.

The first planar attachment member 221 is used to attach the panel to a wall when the clip is embedded in a panel. The first planar attachment member 221 comprises an upper edge 224. In preferred embodiments, the upper edge 224 is shaped. Here, the upper edge 224 is shaped by removing the corners of the material. The first planar attachment member 221 is preferably elongated substantially in the shape of a rectangle. Although a square or other configuration can be used for the first planar attachment member 221, the rectangular shape is desired to provide for the clip to be embedded at a lower height within the panel, while allowing for the second planar member to extend beyond the upper edge of the panel (as shown in FIG. 1). In one embodiment, the first planar attachment member 221 can have a width of about 0.5-1 inch and a length of about 1-3 inches, while the second planar embedding member 222 can have a width of about 0.5-1 inch and a length of about 0.5-1 inch. These dimensions can be scaled up or down to accommodate larger or smaller panels as desired. Due to the first and second planar members being disposed perpendicular to one another, together the two planar members 221, 222 form an L-shape clip 220.

Figure 3:
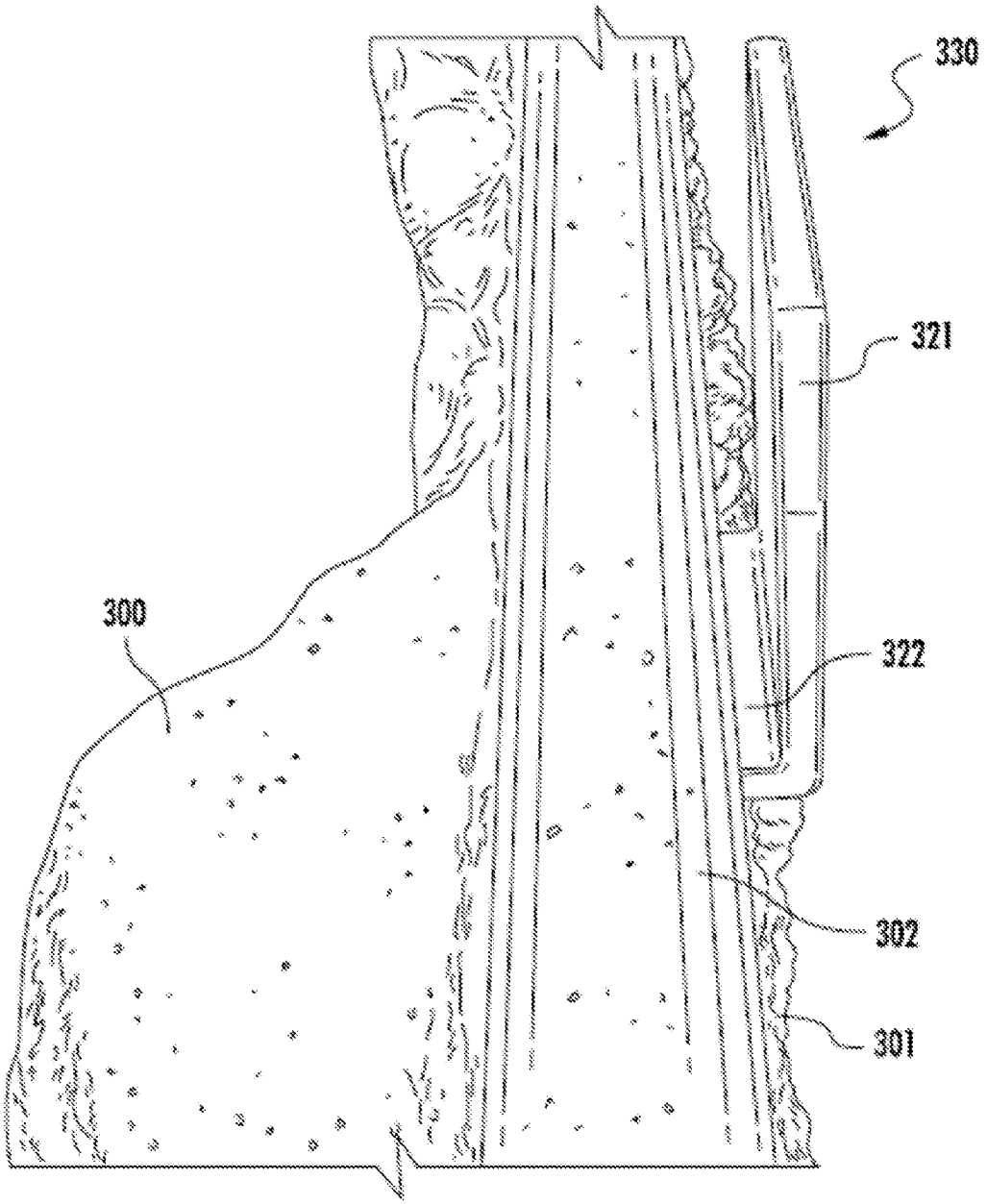
FIG. 3 is a schematic drawing showing a top side perspective view of an exemplary panel of systems of the invention comprising an embedded L-shaped suspension rail and a rounded upper edge or "bull nose" edge.

FIG. 3 is a schematic drawing showing a top side perspective view of an exemplary panel of systems 330 of the invention comprising an embedded L-shaped suspension rail and a rounded upper edge or "bull nose" edge 302. As shown, the L-clip is preferably embedded into the back of a panel using second planar embedding member 222 in a manner to allow an air space between the panel and the clip. In embodiments, this means that the second planar member 222 is embedded only partially into the back face 301 of the panel. Once installed on a wall by attaching the first planar member 221 to the wall, this gap between the clip and the panel will allow for air flow between the panel and the wall and for condensation or water to pass through the gap instead of interfering with the panel or panel system. In existing technologies, especially traditional mortar systems, where there is no gap between the facade and the substrate, the presence of water may degrade the veneer system. The bull nose shaping 302 on the top and bottom edges of the panel 300 allow for interlocking of the panels of the systems when stacked and installed on a wall. In embodiments, the upper edge is a convex rounded shape and is shaped and sized to interlock or mate with a lower edge of a panel that is of a corresponding convex rounded shape. The upper or lower edges can also be configured to have a square cross-sectional shape, where one edge provides a protrusion and the other edge provides a recess for mating with and accepting the protrusion. Any shape edge can be used to mate with another edge in the system. In embodiments, only a portion of the edge or less than the entire length of the edge is shaped for interlocking with another panel.

Cage-type Suspension Rails

Embodiments of the invention further provide a cage-type suspension rail or clip. In the context of this specification what is meant by a cage-type clip is a suspension rail with structure that is almost cage-like in appearance. For example, the suspension rail can comprise a substantially planar member with a plurality of posts projecting at substantially a right angle from the planar member, which posts terminate in and are joined together by a ring of material disposed in a plane substantially parallel to the first planar member. In preferred embodiments, the cage-type rail is preferably made of plastic and is preferably 3-D printed, but can be made according to any conventional plastic manufacturing technique.

Preferred embodiments comprise a suspension rail serving as a cage-type suspension rail configured to be partially embedded in the panel comprising: a first support member with a planar face having a first support member perimeter; a plurality of posts each with a first end disposed on and perpendicular to the first support member; a second support member disposed in communication with the plurality of posts at a second end of each post; a tab in communication with the first support member and having a planar face disposed in a stepped configuration relative to the planar face of the first support member, such that an outline of the faces of the first support member and the tab define a perimeter of the suspension rail, which perimeter is larger than a perimeter of the first support member.

Figure 4:
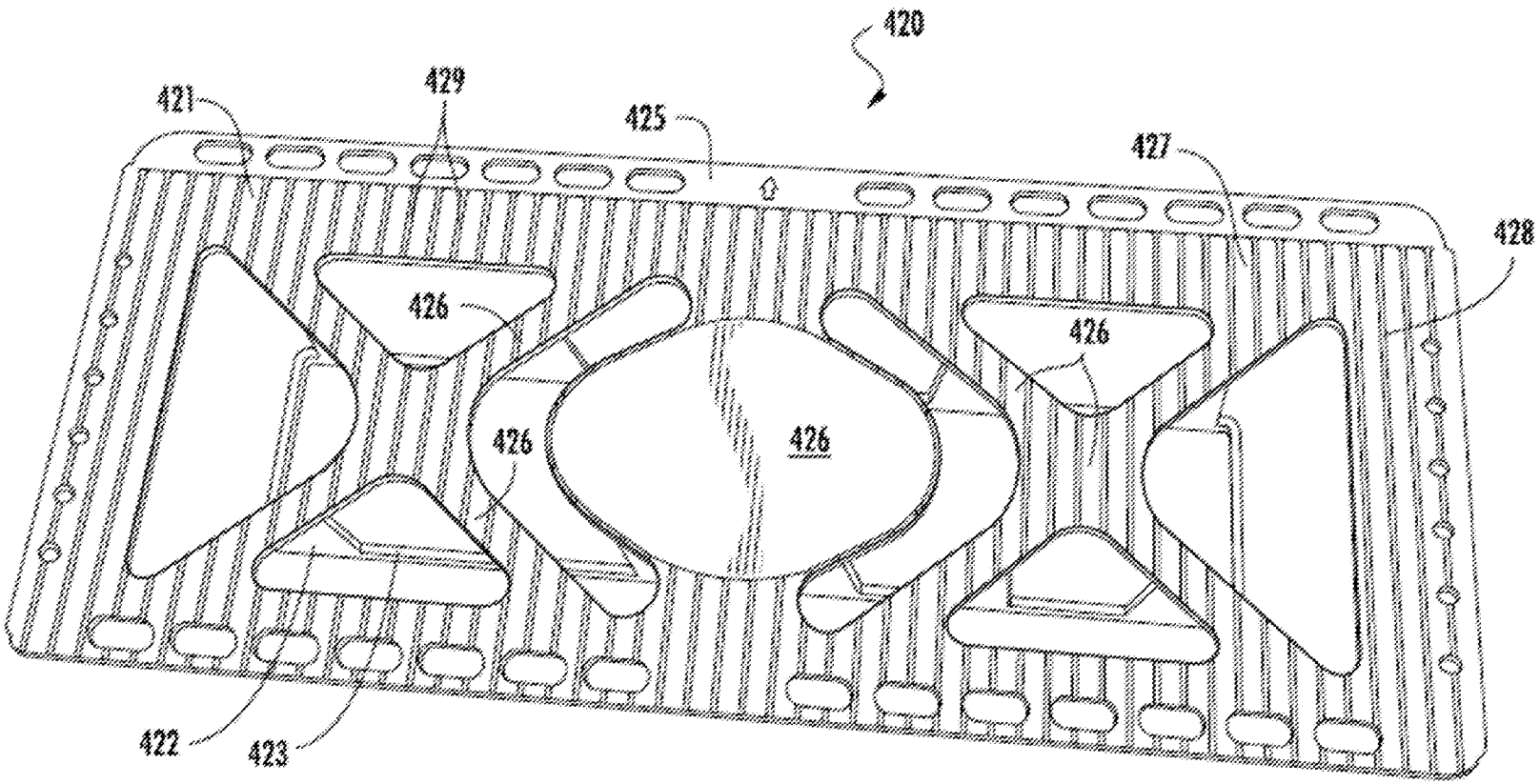
FIG. 4 is a schematic drawing showing a rear perspective view of an exemplary cage-type suspension rail according to the invention.

For example, FIG. 4 is a schematic drawing showing a rear perspective view of an exemplary cage-type suspension rail according to the invention. In the context of this specification, the directional terms used to describe the suspension rails and panels, such as top, bottom, left, right, rear, front, vertical, or horizontal, are not intended to be used in a limiting fashion. Rather, these terms are used to indicate one way the panels and suspension rails can be installed but any direction for any purpose is included. The clip can be fabricated from plastic, composite or metal materials. The typical thickness of the material is between 1 mm to 0.5 inches, such as from 2-5 mm, for example 3-4 mm. One or more components of the clip may be molded, carved or shaped individually and then attached together to form the cage clip, or the cage clip can comprise a single, seamless piece of material.

As shown in FIG. 4, provided is a cage type suspension rail 420 comprising: a first four-sided frame 421 with horizontally and vertically disposed sides. This is also referred to as the first planar attachment member 421, which when embedded in a panel is used to attach the panel to a wall, especially by way of upper attachment tab 425. The suspension rail also comprises one or more cross bar 426 joining two or more sides of the first frame; a plurality of posts 422 extending perpendicularly from the first frame or cross bars; a second four-sided frame 423 in communication with the plurality of posts; and a tab 425 in communication with the frame for connecting the suspension rail to a surface.

In embodiments and to save on material costs the first planar attachment member 421 of the suspension rail can comprise a substantially planar member with voids. In this embodiment, the planar member 421 is essentially a frame comprising two horizontal edges 427 and two vertical edges 428 with interior supports 426 connecting two or more edges of the frame. As illustrated, there are two interior supports 426 shown in an "X" pattern between the horizontal edges 427 and another interior support 426 joining the two horizontal sides of the planar member perpendicularly. In FIG. 4, the face of the planar member shown is the surface that abuts a wall when installed. This face can be rippled 429 as illustrated.

Figure 5:
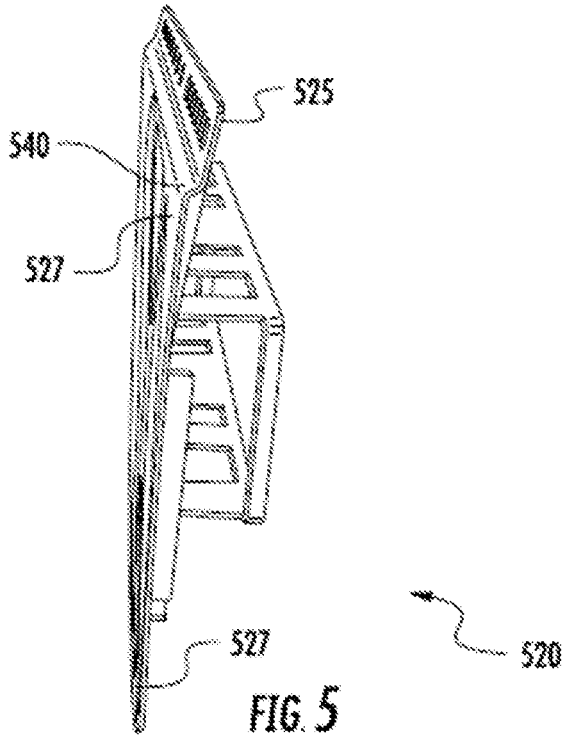
FIG. 5 is a schematic drawing showing a side perspective view of the suspension rail shown in FIG. 4.

FIG. 5 is a schematic drawing showing a side perspective view of the suspension rail shown in FIG. 4. In this embodiment, suspension rail 520 comprises an attachment tab 525 along the upper horizontal edge 527 of the first planar member. This attachment tab 525 is provided in a stepped configuration 540 from the upper horizontal edge 527 of the first planar member. Preferably, the upper attachment tab 525 is stepped away from the upper horizontal edge 527 of the first planar member an amount that is the same as or slightly larger than the thickness of the first planar member. This stepped surface 540 is useful in that when installing a plurality of panels on a surface, one suspension rail 520 of one panel can be placed behind the suspension rail of another panel. For example, during installation of a veneer system, the lower horizontal edge 527 of one suspension rail can be positioned behind the tab of another suspension rail. The length of the horizontal edge 527 can be disposed in contact with the edge of the first planar member where the step 540 is located. In this manner, the suspension rails and thus the panels are self aligned during installation.

Figure 6:
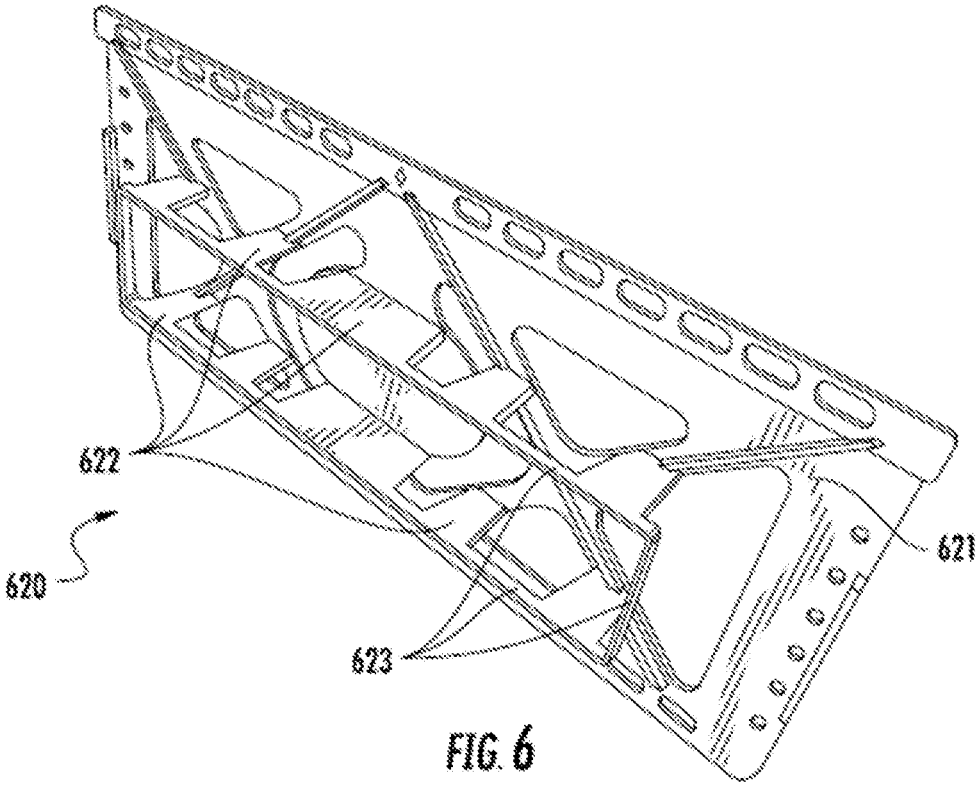
FIG. 6 is a schematic drawing showing a front perspective view of the cage-type suspension rail shown in FIGS. 4-5.

FIG. 6 is a schematic drawing showing a front perspective view of the cage-type suspension rail shown in FIGS. 4-5. As illustrated, the first planar attachment member 621 (otherwise referred to as the first four-sided frame) of suspension rail 620 comprises a plurality of posts 622 disposed perpendicular to the first four-sided frame 621. Here, there are ten support posts 622, however, any number is acceptable, especially from 2-20, such as from 5-15, or preferably 6-10. The support posts 622 can also be any configuration from cylindrical posts to planar members. Here, the support posts are shown as planar members, with planar support posts being stronger and more desired. The support posts 622 are connected to a ring of material 623 disposed in a plane parallel to the first planar member 621. This ring of material 623 is also referred to as the second four-sided frame 623. The second four-sided frame 623 can be any shape or thickness, as here it is illustrated as a rectangle. The support posts 622 and the second four-sided frame 623 are the portions of the suspension rail that are embedded in a panel. Preferably, the support posts of the suspension rail are embedded partially in the panel to leave an air space between the first planar member and the panel. This air space is desired during installation of the panels on a wall to provide for ventilation between the panel and the wall.

Figure 7:
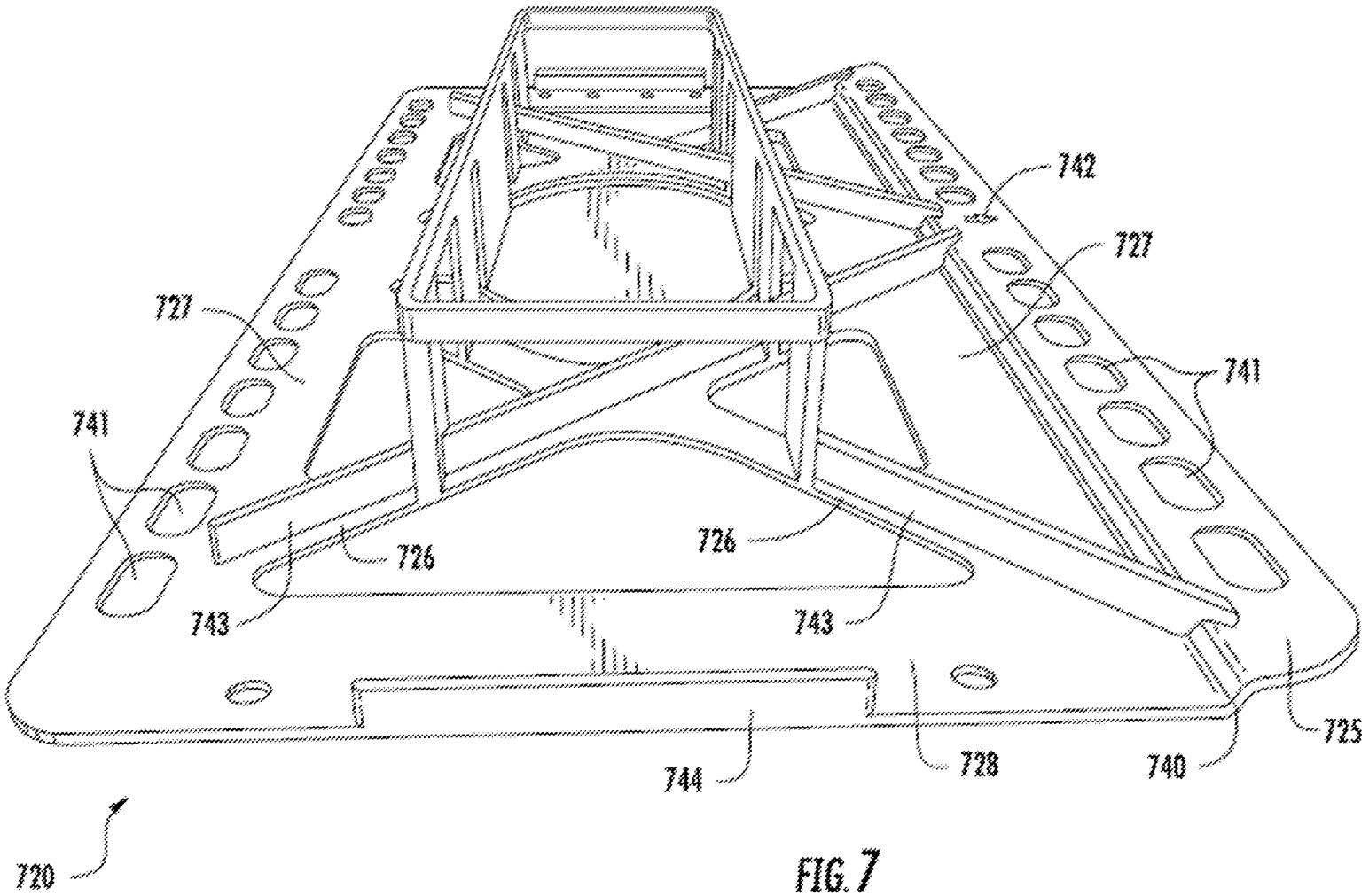
FIG. 7 is a schematic drawing showing a front side perspective view of the suspension rail illustrated in FIGS. 4-6.
Figure 8:
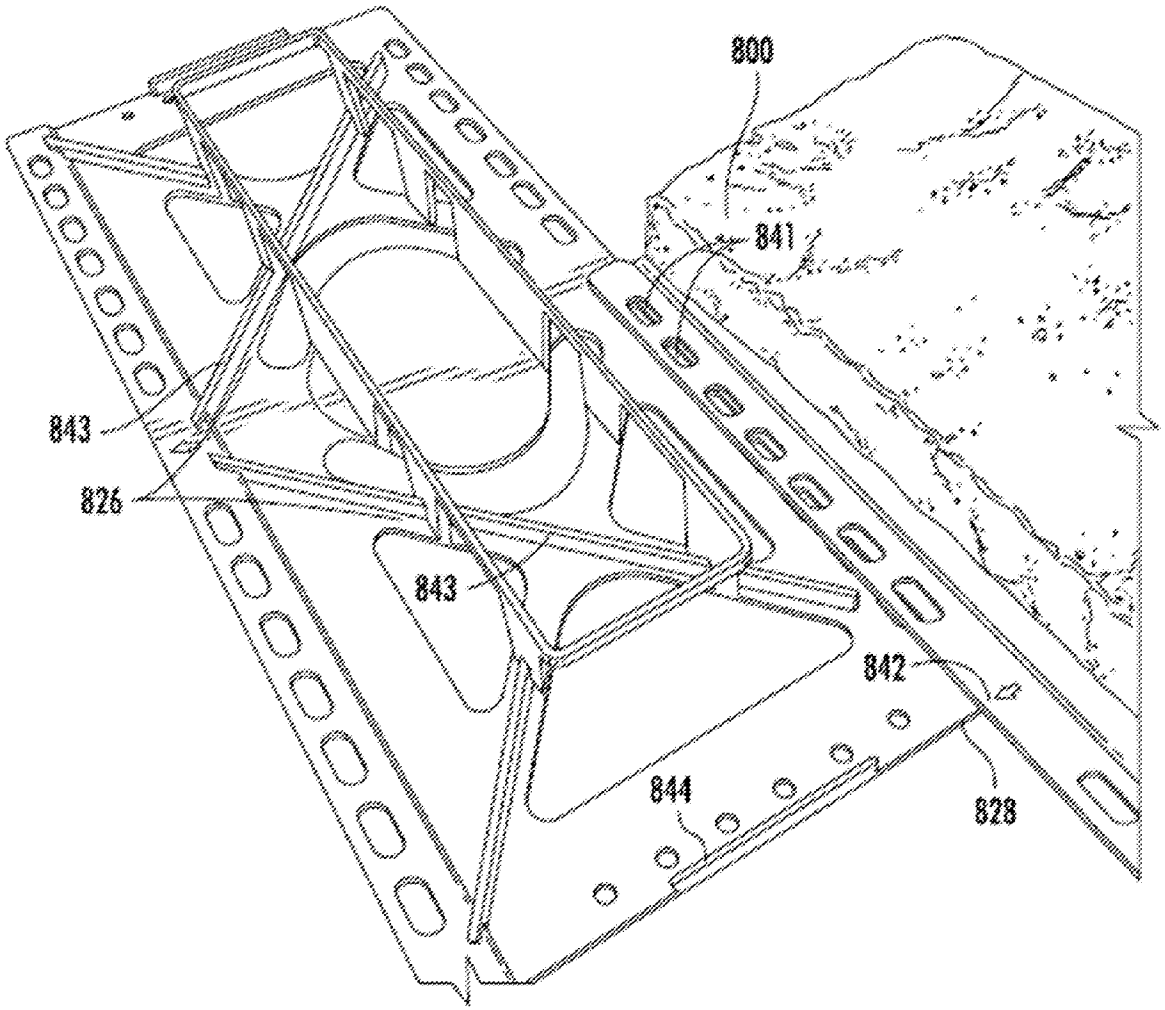
FIG. 8 is a schematic diagram showing a front perspective view of the suspension rail shown in FIGS. 4-7 in combination with another suspension rail demonstrating the self-aligning capability of the suspension rails.

FIGS. 7-8 are schematic drawings of other views of the suspension rail illustrated in FIGS. 4-6. As shown in FIG. 7, along the upper portion of the suspension rail 720 there is an elongated step 740 and upper tab 725. In preferred embodiments, upper tab 725 comprises one or more voids 741 and a spacing/directional indicator 742. Any number of voids 741 along the horizontal edges 727 or upper tab 725 of the first four-sided frame can be used.

As demonstrated in FIG. 8, during installation of the panels 800, the voids 841 can be aligned with one another and the directional indicator (arrow) 842 aligned with an edge of a vertical side 828 of the suspension rail. The plurality of voids can be used for receiving a fastening device, such as a screw or mortar, and the directional indicator can be used for easy and accurate orientation of the clip during installation. The fastening device can include for example adhesive, or a nail, screw, bolt, or staple, for securing an object to a wall surface. The dimensions of the clip are dependent on the size of the panel and are preferably sized such that a portion of the horizontal edges extend beyond the panel face. In most cases this length would not exceed 24 inches, however, the clip is scalable up or down to accommodate larger or smaller structures.

Further illustrated in FIGS. 7-8 are additional support features 743, 843 projecting perpendicularly from the first planar member (the first four-sided frame). Here, the additional support structures 743, 843 are disposed on the "X" supports 726, 826 to provide additional strength to the suspension rail. These additional support features can be disposed anywhere on the first planar member. The suspension rail can also comprise one or more side tabs 744, 844 for easy alignment of the suspension rails and panels during installation of the systems. Side tabs 744, 844 are preferably perpendicular supports along one or both vertical sides 728, 828 of the first four-sided frame of the suspension rail. During installation, the side tab 744, 844 of one suspension rail is abutted against the side tab 844, 744 of another suspension rail to ensure alignment of the panels with respect to one another. Together or separately, the voids 741, 841 along the horizontal edges of the suspension rail, and the spacing/directional indicator 742, 842, as well as the side tabs 744, 844 can contribute to the self-aligning capability of the suspension rails.

Panel with Embedded Cage-type Suspension Rail

Figure 9:
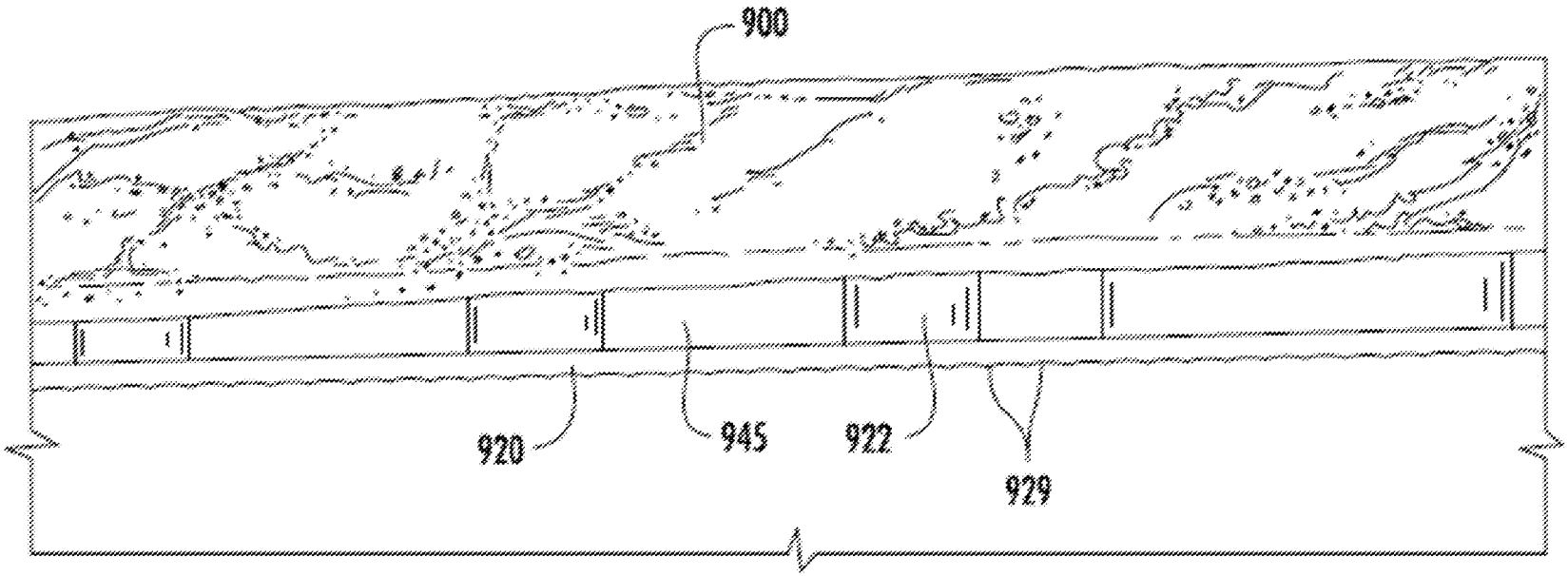
FIG. 9 is a schematic diagram showing a side perspective view of a panel of the invention with an embedded suspension rail, with spacing between the panel and rail.

FIG. 9 is a schematic diagram showing a side perspective view of a panel of the invention 900 with an embedded cage-type suspension rail 920, with spacing 945 between the panel and rail. As shown, only a portion of the support posts 922 are embedded in the panel material, which provides for spacing between the panel and the suspension rail and consequently a ventiallation area between the panel and wall to which the panel is installed. Further, as shown in FIG. 9, the rear face of the suspension rail 920 in one embodiment comprises a rippled surface 929 for increased strength or stiffness in the suspension rail.

Any material can be used to manufacture the panels, including plastic, rubber, wood, stone, metal, glass, cement, ceramic, porcelain, or composite materials. A preferred stone-like material that is light weight can be manufactured from a combination of cement, aggregate, pigments, and admixes. Preferred materials are easy to mold into a desired shape or size and are of a consistency to allow for ease of embedding one or more suspensions rail into the material.

Molds for Preparing Panels with Embedded Suspension Rails

Figure 10:
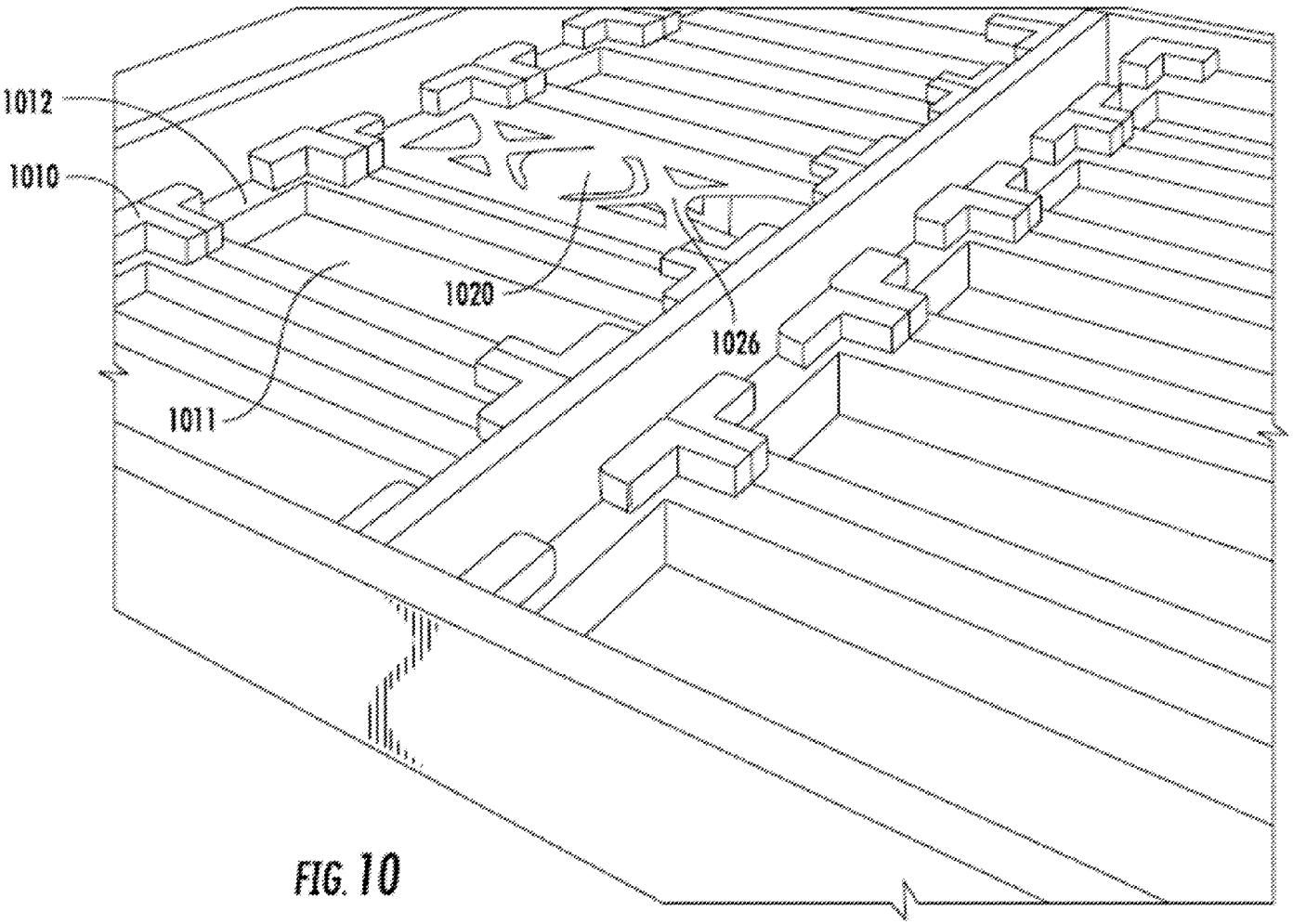
FIG. 10 is a schematic diagram showing a perspective view of an array of molds for manufacturing a plurality of panels of the invention, where a suspension rail is disposed in a mold to illustrate how a suspension rail is embedded in a panel.
Figure 11:
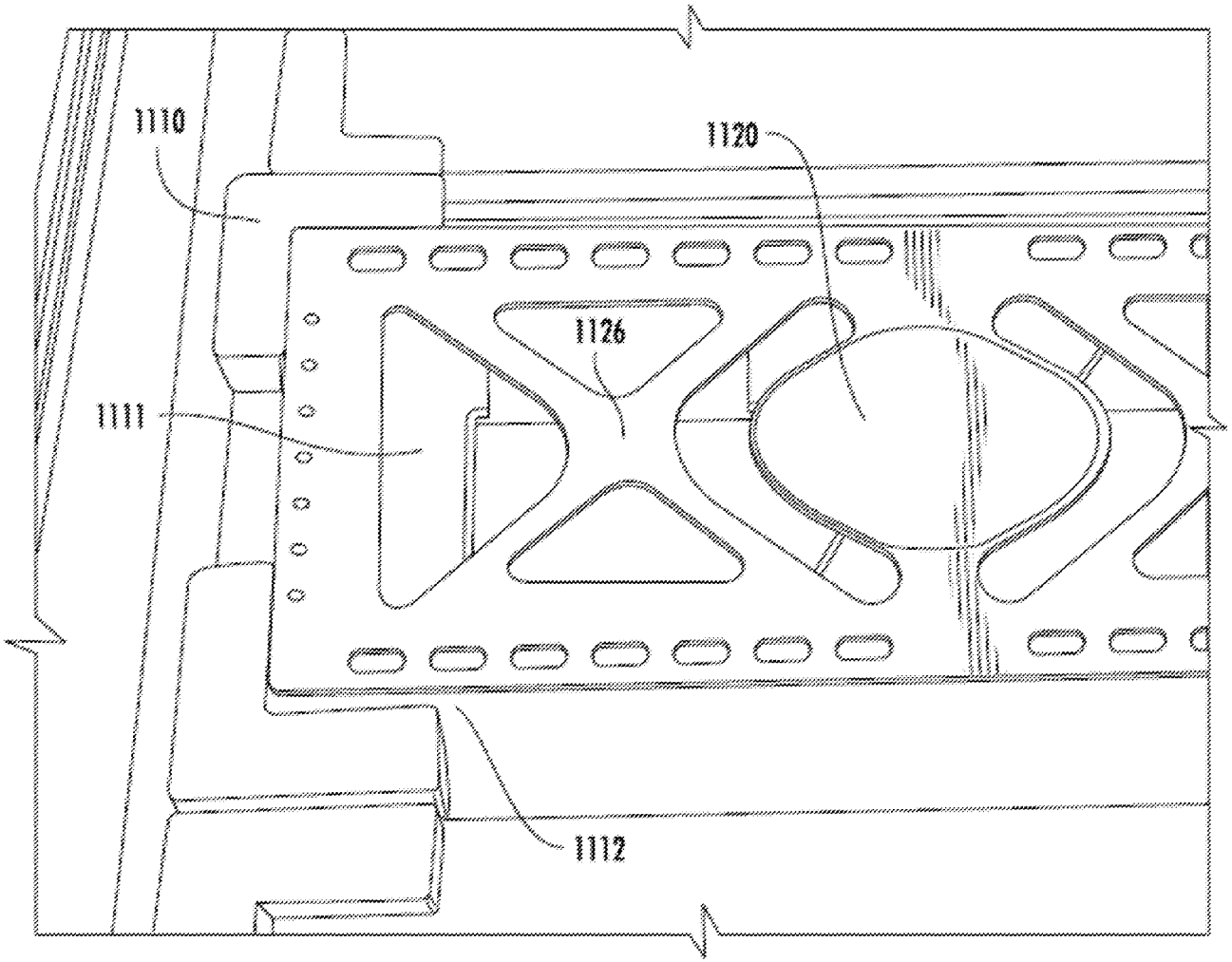
FIG. 11 is a schematic diagram showing a close up of a mold shown in FIG. 10 with a cage-type suspension rail placed within the mold.

Included within the scope of the invention is a method of manufacturing construction panels with embedded suspension rails. As shown in FIGS. 10-11, a polyurethane or silicone mold 1010, 1110 can be use to make any desired shape and size panel. Preferably, the panels and thus the corresponding molds 1010, 1110 are constructed to give an appearance similar to brick or stone. Typically, the exterior facing surfaces of the panel are shaped by the mold and the back of the panel is not molded. However, in embodiments and as discussed in more detail below, it may be preferred to shape or mold at least part of the back surface of the panel. To construct an embedded panel of the invention, the molding material for the panel (e.g., concrete or a composite) can be deposited into the well 1011, 1111 of the mold either manually or automatically. All five interior surfaces of the mold well 1011, 1111 are configured such that when the material to be molded is placed in the well an imprint on the final molded product will result, which imprint has the appearance of brick or stone. The suspension rails (for example, L-shaped or cage type) 1020, 1120 are inserted, manually or automatically, into the material to be molded, while the concrete or composite material is still in a flowable state. This is performed in a manner to dispose the second planar embedding member or the second four-sided frame of the clip into the material for the panel. As illustrated in FIGS. 10-11, the suspension rail is positioned in the mold to position the cage portion of the suspension rail in the material to be molded. Vibrational agitation can be applied to the mold trays to remove air bubbles and ensure that the maximum amount of panel forming material is in direct contact with the mold well. Removal of the air bubbles is generally preferred because air bubbles can both compromise the structural integrity of the panel, and lead to unwanted deformities in the surface pattern. The molding material is allowed to harden or cure. The drying process can be performed at room temperature in air or at an elevated temperature.

As shown in FIGS. 10-11, and in preferred embodiments, the mold 1010, 1110 has a shelf 1012, 1112 for holding the suspension rail 1020, 1120. This shelf positions the suspension rail automatically in a desired position for embedding the suspension rail in the panel. For example, the material for the panel fills the mold to a certain desired level below the shelf. When the suspension rail is inserted into the material that will harden to form the panel, the suspension rail is embedded at a set depth into the panel by virtue of resting on the shelf which supports the perimeter of the suspension rail during the embedding process. In embodiments, the mold is filled with the molding material to a depth that allows for an air gap between the panel and the suspension rail when embedded therein. Due to the configuration of the first planar member of the suspension rail (here, the first four-sided frame), voids between cross bar supports allow for a machine to pick up the suspension rail and place it on the shelf of the mold automatically. For example, a machine can be configured to hold onto the suspension rail at the "X" support position 1026, 1126, then release the rail when placed on the shelf of the mold. In this manner, the panels can be fabricated quickly and easily, as well as uniformly. Each mold is designed and appropriately sized to prevent the suspension rail from being inserted completely into the molding material. Typically, the first planar member of the suspension rail is disposed between about 0.2 to 2 inches above the molding material that hardens to form the panel. In preferred embodiments, there is a spacing between the panel and the suspension rail of about 1-20 mm, such as about 2-15 mm, or about 3-10 mm, or from about 4-8 mm, such as about 5 mm. In one embodiment, this spacing is about 0.3 inches. When the concrete or composite material has solidified, brick or stone facade structures with embedded cage clips are removed from the mold wells and packaged for delivery or sale.

During use or installation at a site, the panels can be installed on any substrate. Preferably, the panels are used to form a veneer of a wall surface, whether indoor or outdoor. In one embodiment of an installation method, starting on the bottom of the wall, the facade element (panel) is positioned at a desired location. A fastening device such as a screw or nail is then driven through one or more voids disposed along the bottom and side edges of the suspension rail, and into the substrate. The next panel is then positioned such that a side tab of its suspension rail is positioned adjacent the side tab of the panel/suspension rail already installed. This step is repeated until a first row of panels is covering the desired length of wall. Once a first row of panels has been secured along the bottom edge of the wall, a second row of panels is installed in a horizontal row above the first row. Each panel in the second row is initially aligned by inserting the bottom edge of the suspension rail behind the top tab of a suspension rail in the first row until the stepped edge of one suspension rail contacts the bottom edge of the other. After the initial alignment, the panel being added to the second row is further positioned by horizontally sliding the panel and aligning its bottom edge voids with the voids of the top tab of the panels in the first row. Even further, for creating a traditional brick type installation, the edge of the panel being installed can be positioned such that one corner of the suspension rail is in line with the positioning indicator (arrow) of a panel in the first row. A fastening device such as a screw or nail is then driven through the aligned voids. This step is repeated until a second row of panels is covering the desired length of wall. This procedure of installing the panels one row at a time may be repeated until the desired area of wall has been covered.

Figure 12B:
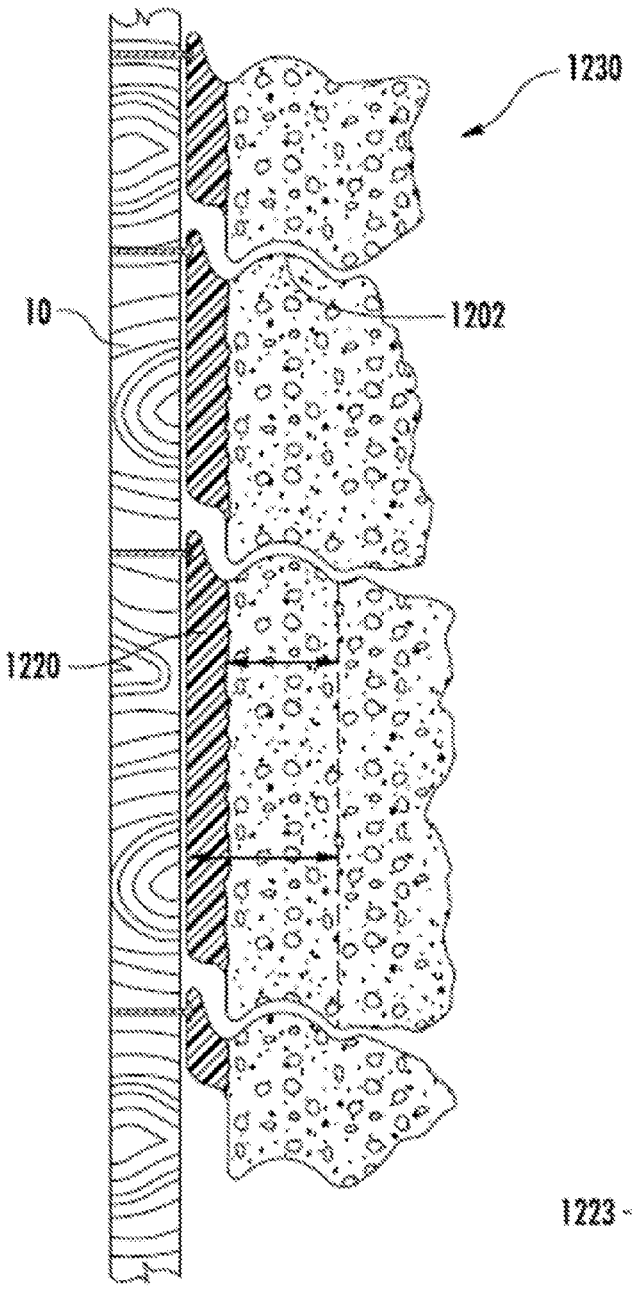
FIGS. 12A and 12B are schematic diagrams of an exemplary cage-type suspension rail of the invention (12A) and the rails embedded in panels installed on a wall (12B).
Figure 12A:
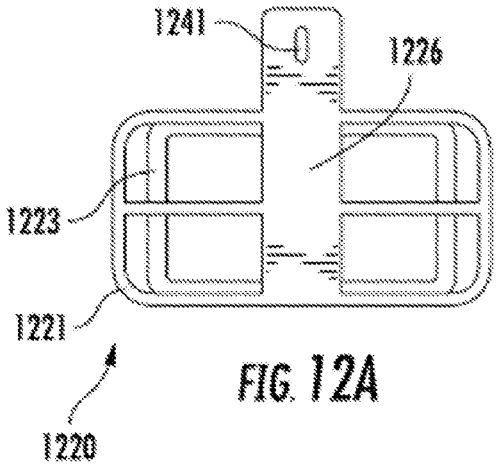

FIGS. 12A and 12B are schematic diagrams of an exemplary suspension rail of the invention (12A) and the rails embedded in panels installed on a wall (12B). As shown in FIG. 12A, the clip 1220 can comprise a first planar member 1221 comprising more voids in its face than material. Here, there is a frame of material 1221 supported by a cross bar type support 1226 joining the upper, lower, and side edges of the frame. On the rear face of the suspension rail, there are perpendicular support posts (not shown) which terminate in a second frame of material 1223 disposed in a plane substantially parallel to the first frame 1221. Optionally, the suspension rail 1220 can comprise one or more voids for receiving a fastener to attach the suspension rail to a wall 1241. As shown in FIG. 12B, the veneer system 1230 can comprise a plurality of panels with embedded suspension rails 1220 attached to a wall 10. When embedded in a panel, the suspension rail 1220 is embedded to a desired depth in the panel. Here, the suspension rail measures ¾ inch between the first and second four-sided frame members and the suspension rail is embedded in the panel up to about ½ inch. In preferred embodiments, the suspension rail is embedded into the panel from about 20-90% of the depth of the suspension rail, such as from 30-80%, or from 40-70%, or from 50-60%. This panel features corresponding rounded edges for providing a bull nose type lock 1202 upon installation of the panels and for providing a panel that is easily removed from the mold during manufacturing. With this type of interaction between panels in an installed system, there is no need for grout as the wall to which the panels are secured will not be viewable.

Panel and Facade System Embodiments

Figure 13:
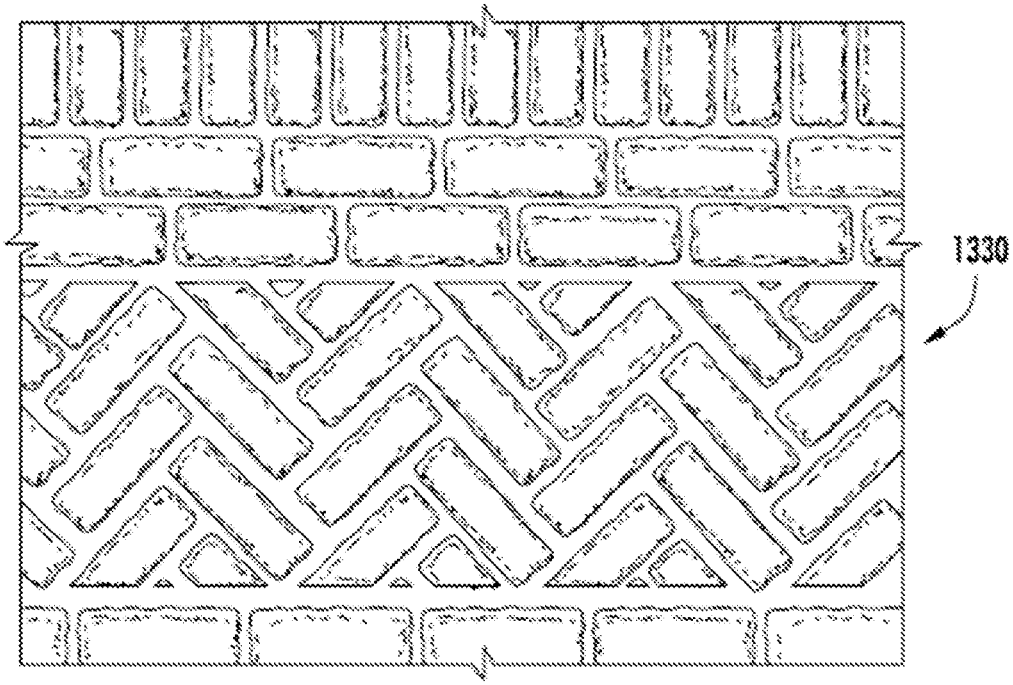
FIG. 13 is a schematic diagram showing a perspective view of a finished facade installed on a wall with brick or brick-like panels and optional mortar between the panels.
Figure 14:
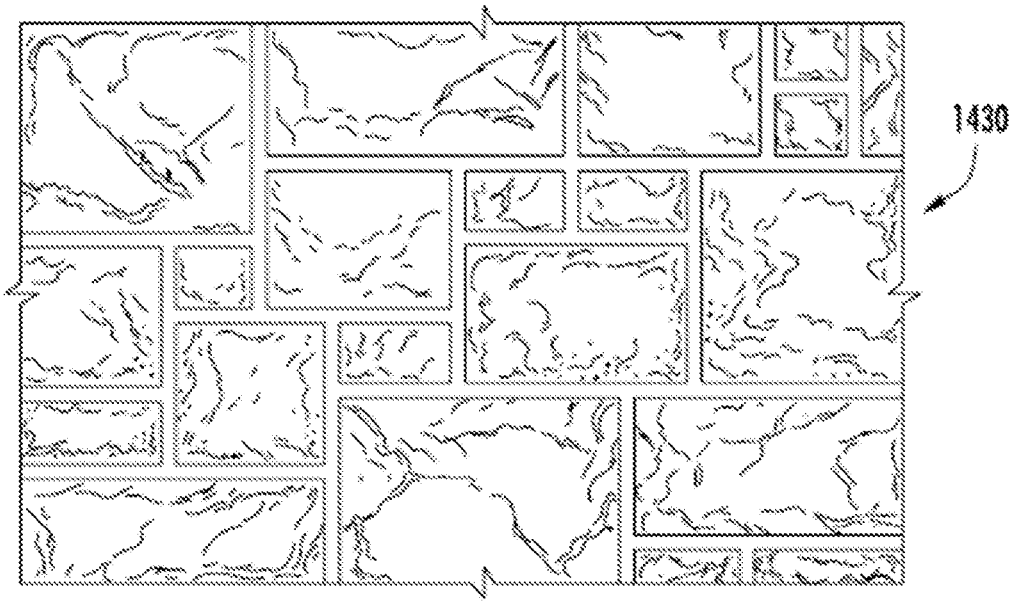
FIG. 14 is a schematic diagram showing a perspective view of a finished facade installed on a wall with stone or stone-like panels and optional mortar between the panels.

FIGS. 13 and 14 are schematic diagrams showing a perspective view of a finished facade 1330 installed on a wall with brick or brick-like panels (FIG. 13) and a finished facade 1430 with stone or stone-like panels (FIG. 14) with optional mortar between the panels.

Figure 15A:
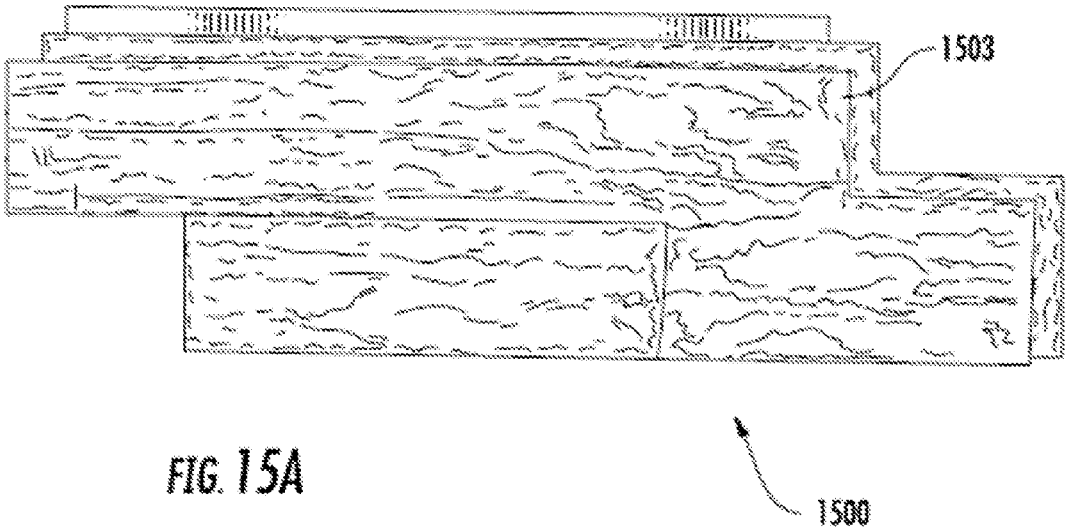
FIGS. 15A and 15B are schematic diagrams of other exemplary panel embodiments of the invention.
Figure 15B:
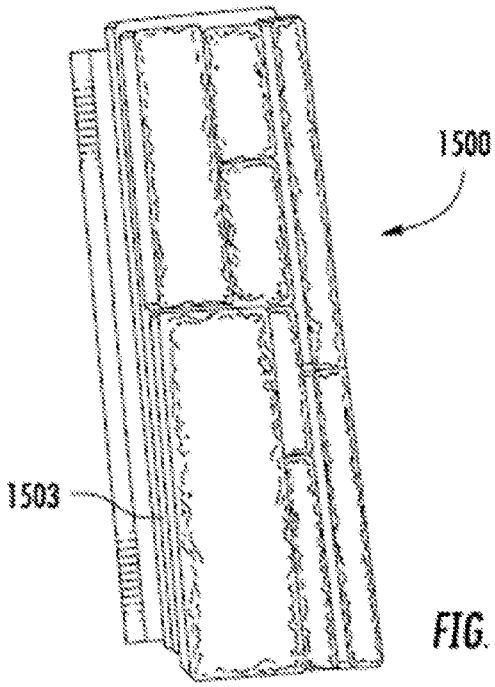

FIGS. 15A and 15B are schematic diagrams of other exemplary panel embodiments of the invention. More particularly, FIG. 15A provides a Z-shaped panel 1530 comprising multiple stacked stones. FIG. 15B is a panel 1530 of multiple stacked stones in an overall block type configuration. An optional feature of panels of the invention and as illustrated in FIGS. 15A-B is that the edges of the panel can comprise a stepped surface 1503 for overlapping with other panels when installed on a wall. The overlap or stepped configuration makes it possible to have a mortarless system since the wall surface will be obstructed from view by the overlapping of the panels. The suspension rails illustrated in this specification can be used with these types of panels as well, or any panel providing a stone, stone-like, brick, brick-like, or multiple stone, multiple brick, multiple stone-like, or multiple brick-like panel. Facade panels of this invention can be configured to resemble and function as the panels disclosed in US Published Patent Application No. 2012-0174516 entitled, "Locking Panel Veneer System," which encompass modular facade panels comprising: (i) a front face for forming part of a first facade, wherein the face is formed as a plurality of stacked stones and has a concave rectilinear polygonal outline configured for mating with adjacent panels when installed in a facade system; (ii) a back side with a suspension rail in communication therewith; and (iii) left and right sides for forming part of another facade in a different plane.

Figure 16A:
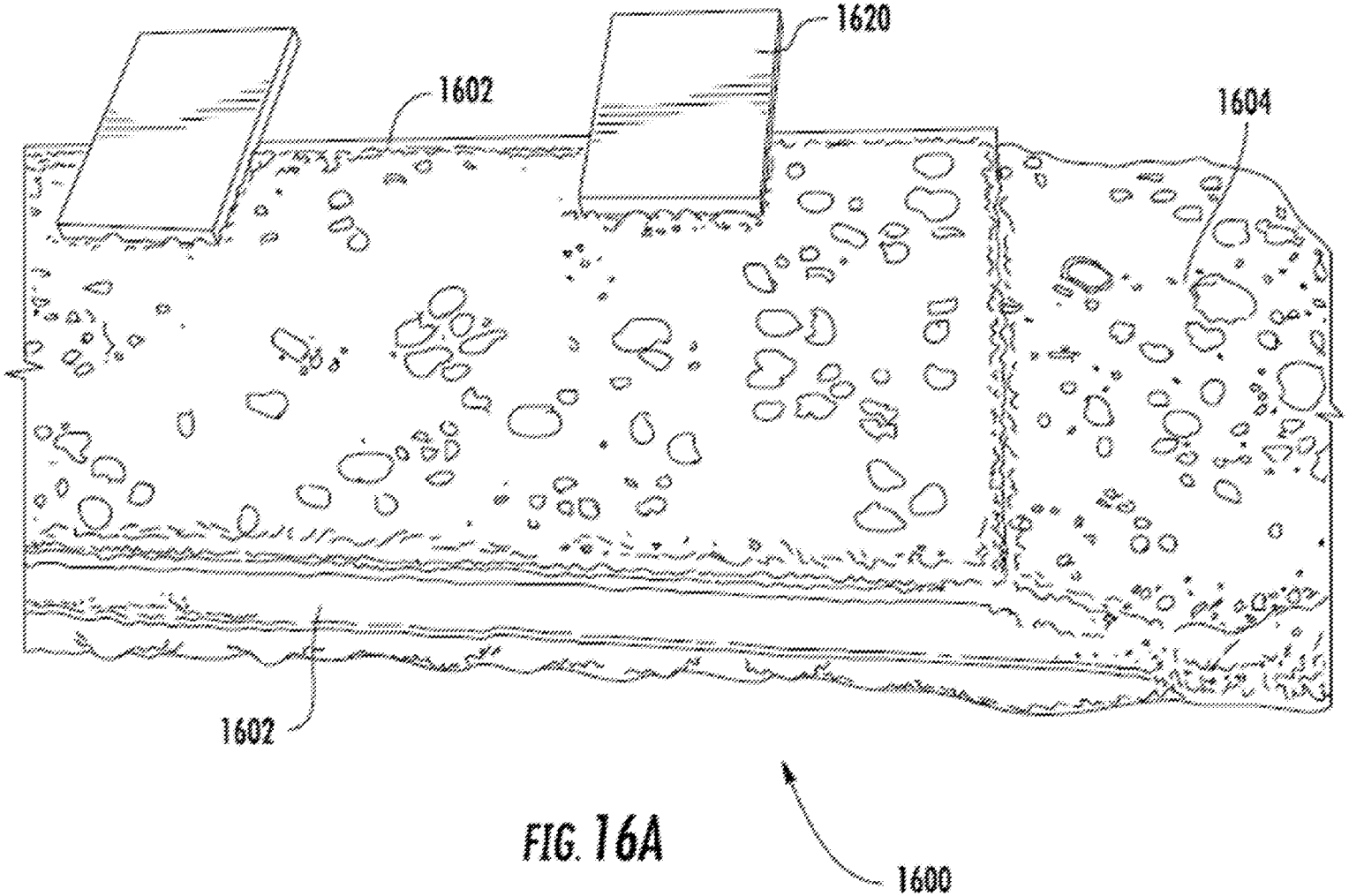
FIGS. 16A-B are schematic diagrams showing a back perspective view (FIG. 16A) and a side perspective view (FIG. 16B) of a panel embodiment of the invention.
Figure 16B:
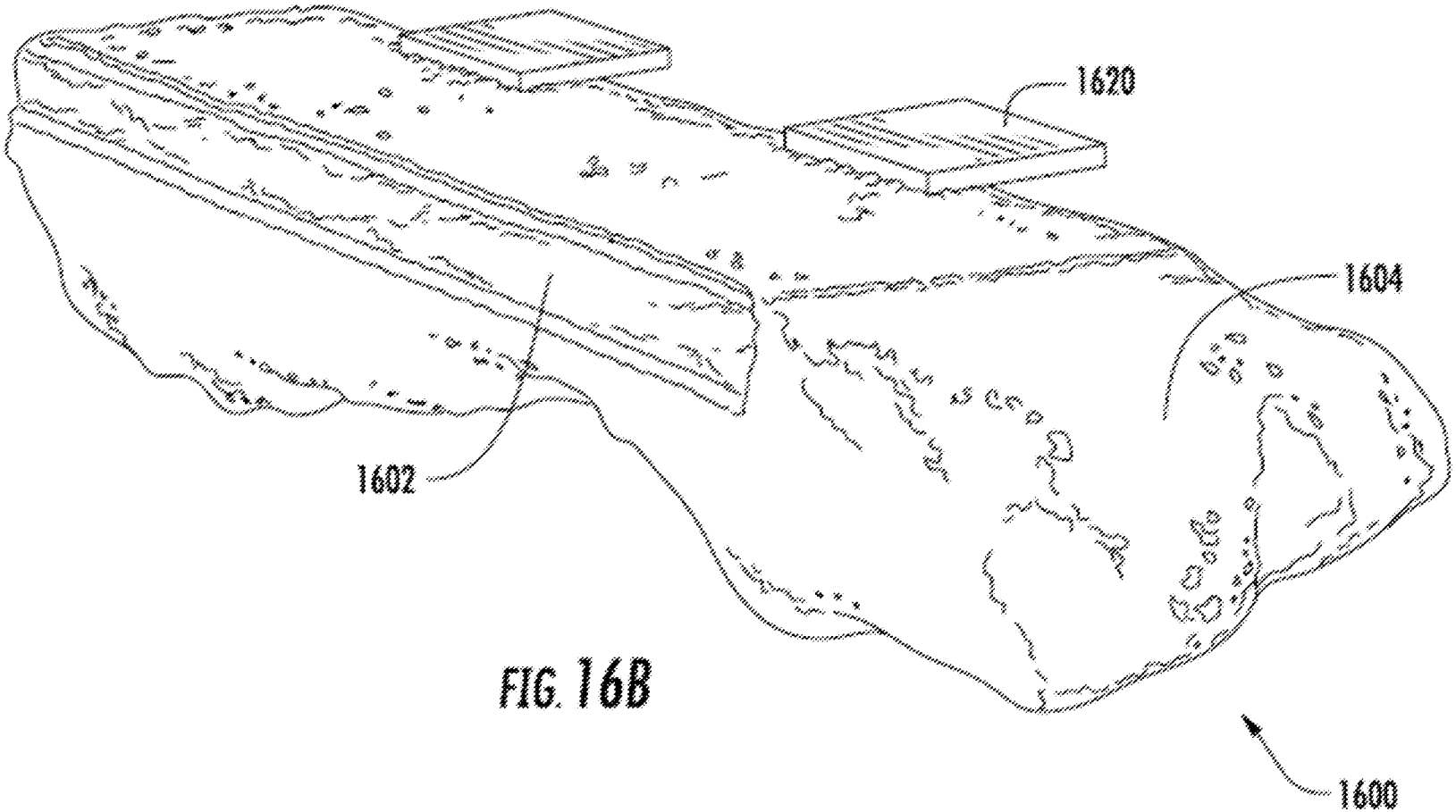

FIGS. 16A-B are schematic diagrams showing a back perspective view (FIG. 16A) and a side perspective view (FIG. 16B) of a panel 1600 embodiment of the invention comprising a corner facade element (panel), two embedded L-shaped clips 1620, and top and bottom panel edges 1602 for interlocking with other panels in a system. This panel embodiment has a specially shaped end 1604, which allows the panel to be installed on a corner surface without revealing that the panel is manufactured as opposed to natural stone. For example, one end of the panel is shaped around all sides of the panel to have a natural stone look. This type of panel is especially useful for covering corner surfaces, such that when installed the end can abut the end of another panel covering an opposing surface at the corner. Since all sides of the ends of the panels are molded to have the look of natural stone, there is no indication at the corner that the panels are manufactured. Corners are usually vulnerable places where a system can be identified as manufactured or synthetic, but with the panels manufactured in this way, the system appears just as a natural stone or brick system would. One way of preparing this type of embedded panel is by using a specially designed mold. For example, a shoe or slipper type mold can be used, which resembles a slipper. Instead of having a completely open upper surface (as shown in FIGS. 10 and 11), a portion of the mold at one end is covered. This covered portion of the mold has texturing on all sides of the mold to provide for a panel having one end textured or molded on all exterior surfaces to resemble brick or stone.

The molds, and consequently the panels, are scalable and can be fabricated in a variety of sizes. Typically the panels have a height between 1 and 24 inches, a length between 1 and 24 inches, and an average width between 0.5 and 4 inches. Preferably, the height and/or length ranges from about 1-16 inches, or from about 2-12 inches, or about 3-10 inches, or about 4-8 inches, such as about 5-6 inches, while the width ranges from ¾ inch to 2 inches. In embodiments, the panels can be configured to comprise a single manufactured stone or brick or a plurality of stones and bricks.

Universal Hanging-type Suspension Rails

In addition to cage-type suspension rails described above, embodiments of the invention may include universal hanging-type suspension rails that provide pull-out resistance. Included in embodiments of the invention is a universal suspension rail or bracket comprising: an elongated planar member with upper and lower longitudinal edges, upper and lower c-shaped channels disposed along and formed in part by the longitudinal edges of the planar member, one or more feet in communication with the planar member or the upper or lower c-shaped channel and disposed perpendicular thereto, a v-shaped groove disposed lengthwise along and in communication with the upper c-shaped channel, an upper planar mounting bar disposed lengthwise along and in communication with the v-shaped groove and parallel to the planar member, and a lower planar mounting bar disposed lengthwise along and in communication with the lower c-shaped channel and disposed at an angle in the range of about 135 to 180 degrees relative to the planar member. In embodiments, the upper planar mounting bar is disposed in a plane spaced a greater perpendicular distance from the elongated planar member than a longitudinal edge of the lower planar mounting bar.

Figure 17A:
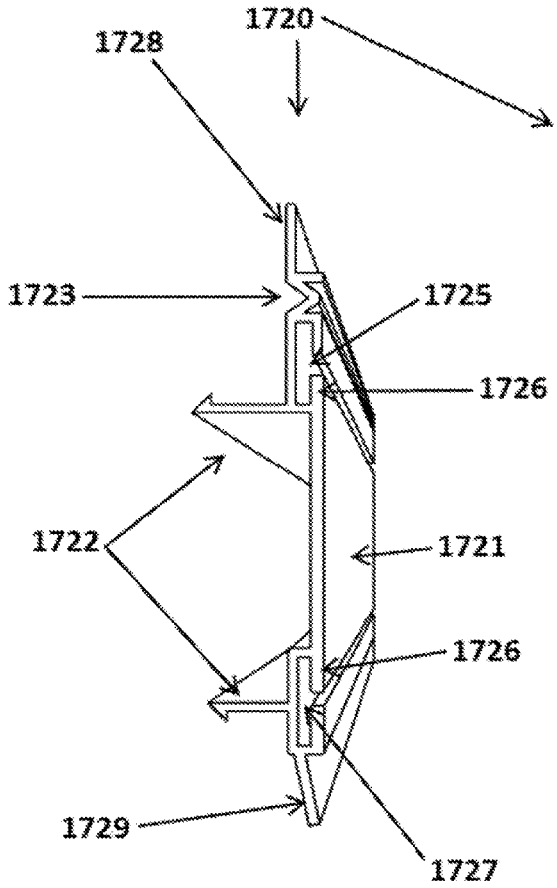
FIGS. 17A-C are respectively a side elevation view, a top planar view, and a bottom perspective view of a universal hanging bracket embodiment of the invention.
Figure 17B:
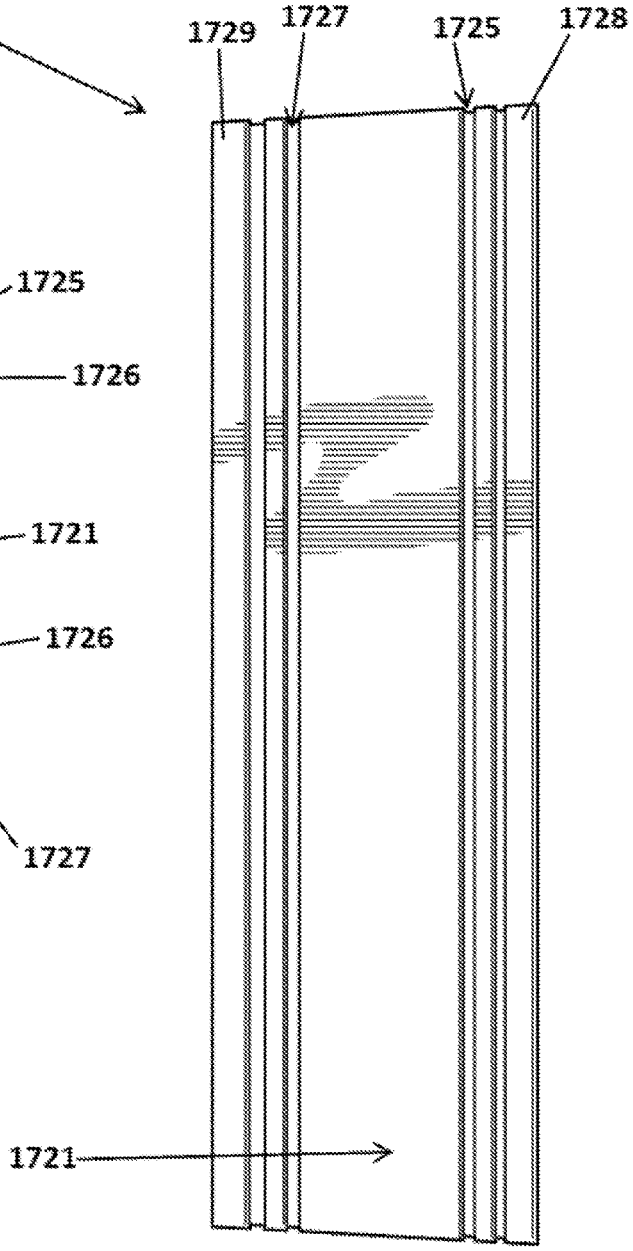
Figure 17C:
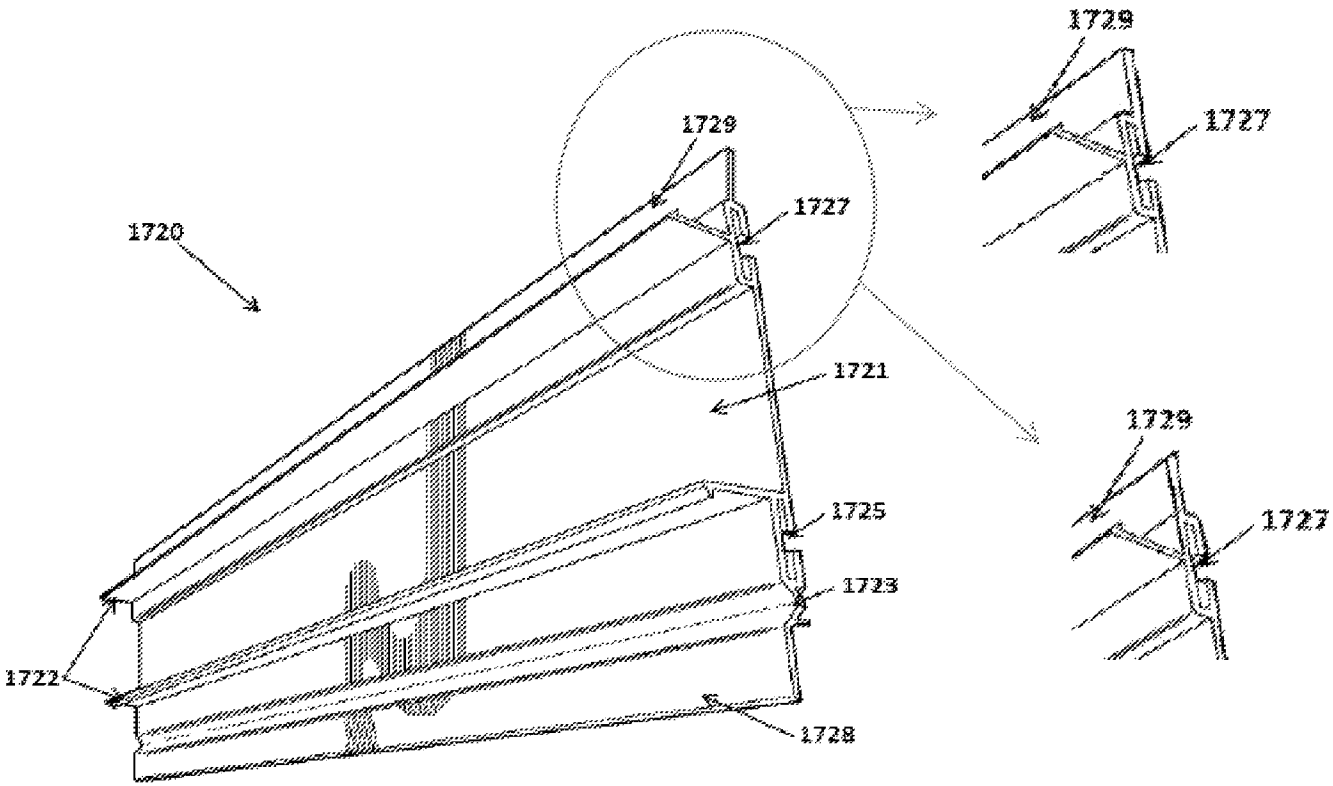

FIGS. 17A-C provide various views of a hanging suspension rail embodiment according to the invention. Provided by this embodiment is a suspension rail 1720 comprising: an elongated planar member 1721 with upper and lower longitudinal edges 1726; upper and lower c-shaped channels 1725 and 1727 disposed along and formed in part by the longitudinal edges 1726 of the planar member; one or more feet 1722 in communication with the planar member 1721 or c shaped channel 1725 or 1727 and disposed perpendicular thereto; a v-shaped groove 1723 disposed lengthwise along and in communication with the upper c-shaped channel 1725; an upper planar mounting bar 1728 disposed lengthwise along and in communication with the v-shaped groove 1723 and parallel to the planar member 1721; and a lower planar mounting bar 1729 disposed lengthwise along and in communication with the lower c-shaped channel 1727 and disposed at an angle in the range of about 135 to 180 degrees relative to the planar member 1721.

Embodiments of the invention include a dual extrusion suspension rail 1720 (used interchangeably with bracket or hanger or rail) for incorporating (e.g, molding or forming) into each panel of the veneer system. As shown in FIG. 17A, the suspension rail 1720 has a low profile planar body with protrusions or feet 1722 extending from the body about perpendicular thereto. These protrusions or otherwise referred to as feet 1722 facilitate embedding of the bracket into a material to be molded into a desired shape (i.e., panel). Here, there are two feet 1722 each of which comprises structure for preventing or resisting removal of the feet 1722 from the panel material once cast or molded. These protrusions are integral to the body and in this embodiment made of the same plastic material as the body. The protrusions extend lengthwise along the body and can be molded into the panels of the invention to provide a panel with hanger that will resist pull out from the panel and not break free from the panel. Other means for securing the hanger to the panel can be used, such as posts instead of lengthwise planar elements, however, the more material of the hanger that is molded into the panel the more secure the hanger will be within the panel. Here, two feet 1722 are provided, but any number can be used.

FIG. 17B shows the back face of the hanger, which comprises one or more grooves in the plastic material along the length of the bracket to provide flexibility in positioning of the engagement arms of the bracket. Any means for incorporating flexibility into the suspension rail 1720 can be used, including using a plastic or metal material for the suspension rail body that is flexible enough to bend into a desired shape or has flexibility that allows for temporary bending of the suspension rail 1720. Such flexibility is advantageous to allow for some variability in the positioning of the panel into a facade system during installation. As shown, another means for allowing some movement of the mounting bars 1728 and 1729 relative to the planar member 1721 can be provided by the c-shaped channels 1725 and 1727 that extend lengthwise along the edges of the planar member 1721.

With respect to the two elongated engagement arms (mounting bars) 1728 and 1729, these arms can be configured such that the bottom surface of one arm is capable of overlapping with the top surface of the other arm on a different bracket. When embedded in a manufactured stone, the universal brackets can be disposed in a manner to provide the elongated engagement arms 1728 and 1729 along the horizontal length of the stone at the top and bottom of the stone, or any part thereof. The engagement arms or mounting bars 1728 and 1729 need not be as long as the length of the panel to which they are connected, however, the greater the length of the suspension rail 1720, the greater the strength of the system.

The bottom arm 1729 of the bracket is capable of engaging or overlapping with the top arm 1728 of another bracket of a panel disposed immediately below the panel being placed into the system. The surfaces that engage one another are the surface of the bottom arm 1729 of a first panel that faces the panel and the surface of the top arm of another panel that faces away from the panel. Engagement in the context of this specification refers to overlapping surfaces and the surfaces need not physically be in contact with one another upon installation, however, a more stable facade system will result if there is an interference fit between engagement arms 1728 and 1729 of the panels. Engagement arms 1728 and 1729 are disposed in approximately the same orientation with respect to the stone. In preferred embodiments, the upper engagement arm 1728 is disposed in a plane parallel to the planar member or body 1721 of the suspension rail 1720, while the lower mounting bar 1729 is angled slightly toward the planar member. For example, the lower mounting bar 1729 can be fixed at an angle relative to the planar member 1721, such as approximately in the range of 135-180 degrees away from the top surface of the planar member. With the lower mounting bar 1729 at a slight angle relative to the planar member 1721 and thus relative to the upper mounting bar 1728, insertion of that panel into the facade system is facilitated in that the lower engagement arm 1729 can be inserted behind the upper engagement arm 1728 of another panel immediately below the panel being installed and engagement of the two surfaces will be automatic due to the angle of the lower mounting arm 1729.

Figure 18:
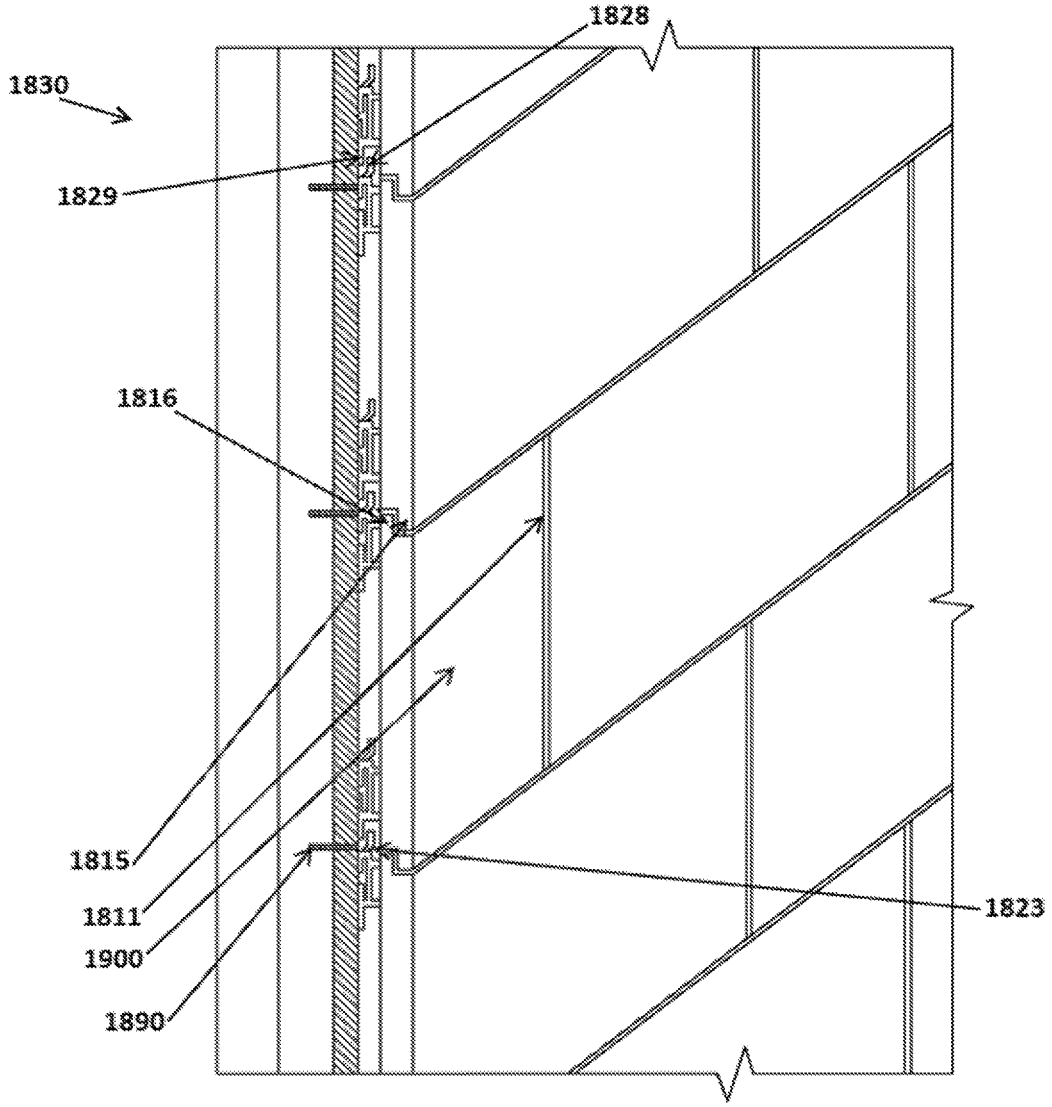
FIG. 18 is a schematic drawing of a mortarless veneer system comprising multiple universal suspension rails according to an embodiment of the invention.

Engagement of the engaging arms of the bracket(s) is also shown in FIG. 18. In some embodiments, the mounting bars in combination with the panel can provide four surfaces for engagement to resist pull out of the panel or adjacent panels away from the wall to which they are attached.

FIG. 17C shows embedding feet 1722 disposed lengthwise along rail 1720. As is further shown, structure can be incorporated into the lengthwise protrusions (i.e., feet) 1722 to provide additional pull out resistance, such as opposing hooks or directionally opposed hooks as shown. Another feature of the bracket is the V-shaped cut out 1723. This provides a position for a screw or other securing means to be positioned when fastening the panel to the wall. For example, once a panel is positioned into a desired place within the veneer system, a screw can be used in combination with the V-shaped cut out to secure the stone panel to the face of the wall and provide the head of the screw in a recessed position with respect to the bracket. The advantages of such a system should be immediately apparent in that the panels can be secured quickly and easily to the wall and interlocked with one another to provide a strong veneer system without the need for mortar.

Other rail configurations are also included within the scope of the invention. Preferred are universal brackets that can be installed along any side of a panel without requiring a side-specific configuration. A universal bracket is smaller and requires less plastic material. Ideally, the universal bracket comprises two surfaces capable of engaging corresponding surfaces of another bracket of the same type, although only one engagement surface of the bracket is actually used to engage a similar surface of another panel. In other words, two universal brackets would be used for each panel as opposed to the single bracket described in FIGS. 17A-C. The base of the bracket can comprise at least two feet for facilitating the embedding of the bracket into a material to be molded into a desired shape. Here, there are two feet each of which comprises structure for preventing or resisting removal of the feet from the panel material once cast or molded. Another feature of the brackets is the two elongated engagement arms. The engagement arms are configured such that the bottom surface of one arm is capable of overlapping with the top surface of the other arm on a different bracket. With two pieces needed to accomplish the same function as the single piece bracket described above, manufacturing of the stone panels may be slightly more complex due to the placement of two brackets instead of one. Non-universal brackets can also be used with the cost of manufacturing and complexity of the configurations being increased.

Specific universal brackets can include brackets measuring about 2 inches by about 5½ inches for equipping a rectangular shaped extruded panel that measures about 11 inches long and 5½ inches wide. Again, it is not critical the size, shape, or material of any panel or bracket of the invention and dimensions and materials can be altered according to desired needs. The bracket(s) can be embedded in the panels during manufacturing in such a manner to dispose the brackets on the rear face of the panel. Although any number of brackets can be used to support a particular panel, such as 1, 2, 3, 4, 5, 6, 7, 8, 9, 10, and so on (limited only by the size of the panel and the size of the brackets), ideally two universal brackets are used (one at each of opposing sides of the panel) and are disposed along the entire length of the panel.

For example, one bracket measuring about 5.5 inches long could be positioned and embedded in one end of the panel that measures about 5.5 inches long. A second bracket (universal, i.e., of the same configuration as the first bracket) could be embedded at the opposing end of the panel that measures about 5.5 inches long. Such a panel would then be inserted into the veneer system with the shorter 5.5 inch sides disposed horizontally to enable the brackets of the panel to engage with the panels adjacent to it and disposed above and below the panel in the system.

Alternatively, one or two brackets could be disposed and embedded in the panel along the 11 inch sides of the panel. In this case, one bracket could be installed at each side (leaving about half the length of the 11-inch sides unsupported with a bracket) or two brackets could be disposed side by side along each 11-inch side so that the entire or substantially the entire length of each 11-inch side is supported by brackets. A panel operably configured in this manner can be installed into the veneer system so that the 11-inch sides were horizontal.

Using smaller universal brackets in this way further increases ease of manufacturing in that the brackets can be used both for smaller and larger panels. More specifically, for example, two 5.5 inch brackets could be used on opposing sides of a square panel measuring about 5.5 inches on each side, or two or four 5.5 inch brackets could be used on an 11-inch side of a rectangular panel (as just described).

Yet another bracket embodiment can comprise engaging arms configured to be about the same length and width and disposed in parallel, adjacent or abutting horizontal planes. It is not critical the degree to which the planes in which the engaging arms lie are adjacent or if they abut one another, but it is important to note that the closer the clearance between the two, the tighter the fit between panels of the system and the less movement of the panels will be experienced post-installation.

An alternative embodiment of a bracket according to the invention includes another single piece rail. Incorporated into its configuration are the engaging arms, only just one bracket is needed instead of two to provide the corresponding top and bottom engaging arms disposed along the length of the panel at the top and bottom of the back portion of the panel. In this embodiment the base or body of the bracket hanger comprises at least two feet for facilitating the embedding of the bracket into a material to be molded into a desired shape. Here, there are four such feet each of which comprises structure for preventing or resisting removal of the feet from the panel material once cast or molded. The structure for resisting removal of the feet from the molded panel in this embodiment comprises a hook at the end of each foot. Here, the hooks are oriented in the same direction, but can be oriented in different directions as well. Another feature of the brackets is the two elongated engagement arms. The engagement arms are configured such that the bottom surface of one arm is capable of overlapping with the top surface of the other arm on a different bracket. When embedded in a manufactured stone, the brackets are disposed along the horizontal length of the stone at the top and bottom of the stone. Both brackets are disposed in the same orientation with respect to the stone. As shown, the bottom arm of the bottom bracket is capable of engaging or overlapping with the top arm of a top bracket of a panel disposed immediately below the panel being placed into the system. The surfaces that engage one another are the surface of the bottom arm of the bottom bracket (of a first panel) that faces the panel and the surface of the top arm of the top bracket (of another panel) that faces away from the panel.

The universal suspension rails may be manufactured by any suitable manufacturing method. In some embodiments, the universal brackets may be made of hard plastic and 3-D printed or made from individual molds or other conventional plastic manufacturing techniques such as injection molding. In other embodiments, the universal brackets may be made of sheet metal and manufactured by a CNC cutting machine according to CAD drawings, then pressed or bent to produce the individual features. The universal brackets may be manufactured of unitary construction or individual components joined together, such as through soldering or welding.

Embodiments may include suspension rails that are modified versions of the suspension rails shown in FIGS. 4-8 and FIGS. 17A-C. The modified versions may omit one or more features, include one or more additional features, or substitute one or more features. Particularly, the cage-type suspension rails of FIGS. 4-8 may include features of the universal brackets of FIGS. 17A-C and vice versa. For example, one embodiment includes a cage type suspension rail of FIGS. 4-8 that includes feet such as the feet 1722 shown in the universal suspension rails of FIGS. 17A-C. For example, the feet 1722 may be in communication with the second four-side frame 623 as shown in FIG. 6. In other embodiments, the feet 1722 may entirely replace the second four-sided frame 623. The feet may be disposed at any angle to provide for another engagement surface with a panel. Another embodiment includes a universal suspension rail of FIGS. 17A-C that includes at least one void 741, 841 of the cage-type suspension rails shown in FIGS. 7 and 8. For example, one or more voids may be positioned along the mounting bars 1728 and 1729 to provide for better alignment and means for securing the mounting bars together such as with a fastener. In addition, other embodiments with combined features of the cage-type and universal suspension rails are possible. The present invention contemplates any combination of the features of the suspension rails embodiments shown in FIGS. 4-8 with those shown in FIGS. 17A-C and vice versa. Further, the suspension rails of FIGS. 4-8 and FIGS. 17A-C may include one or more features not described herein alternatively or in addition to what is shown. Additionally, the type of panel that is mounted with the suspension rail, whether brick or brick-like, stone or stone-like, or other suitable veneer may also be interchangeable. Additional examples of embodiments of the suspension rails of FIGS. 4-8 and FIGS. 17A-C and their advantages will be apparent to a skilled artisan, including those not specifically recited or depicted herein.

Veneer System Employing Universal Hanging-type Suspension Rails

FIG. 18 is a schematic diagram showing installation of a veneer system 1830 according to the invention that employs the inventive universal suspension rails. This system, and any system or panel described in this specification, can be installed with or without mortar. One advantage of the systems of the invention is that mortar is not required, but can be optional for additional support, strength, or longevity of the overall system. As shown in FIG. 18, each panel 1900 of this embodiment once installed on a surface resists pullout of the panel and adjacent panels by engaging or overlapping one or more adjacent panels along the panel itself or along their suspension rails, or a combination thereof. In the embodiment, the panels are installed on a wall surface by inserting screws 1890 through v-shaped grooves 1823 in the hanging brackets. Preferably, as shown, each panel comprises engagement surfaces for engaging at least three sides of the panel with at least three adjacent panels in the system. The overlapping surfaces can be any combination of one or more surfaces of the panel itself or one or more surfaces of a bracket installed in the panel. More particularly, each panel in this embodiment has a vertical engagement surface 1811 that overlaps with the vertical engagement surface of an adjacent panel. Each panel also has a horizontal engaging surface 1815, 1816 for overlapping with a horizontal surface of another panel in the system. The hanging bracket(s) provide two additional horizontal engagement surfaces 1828, 1829 for interacting with horizontal surfaces of other panels in the system. In this embodiment, the suspension rails are considered universal in that they can be incorporated into either the upper part or lower part of the tile and provide the same function. Preferred embodiments have four engaging surfaces on the panels themselves, such as on both vertical and both horizontal edges, and two additional engagement surfaces provided by the suspension rails.

Figure 19:
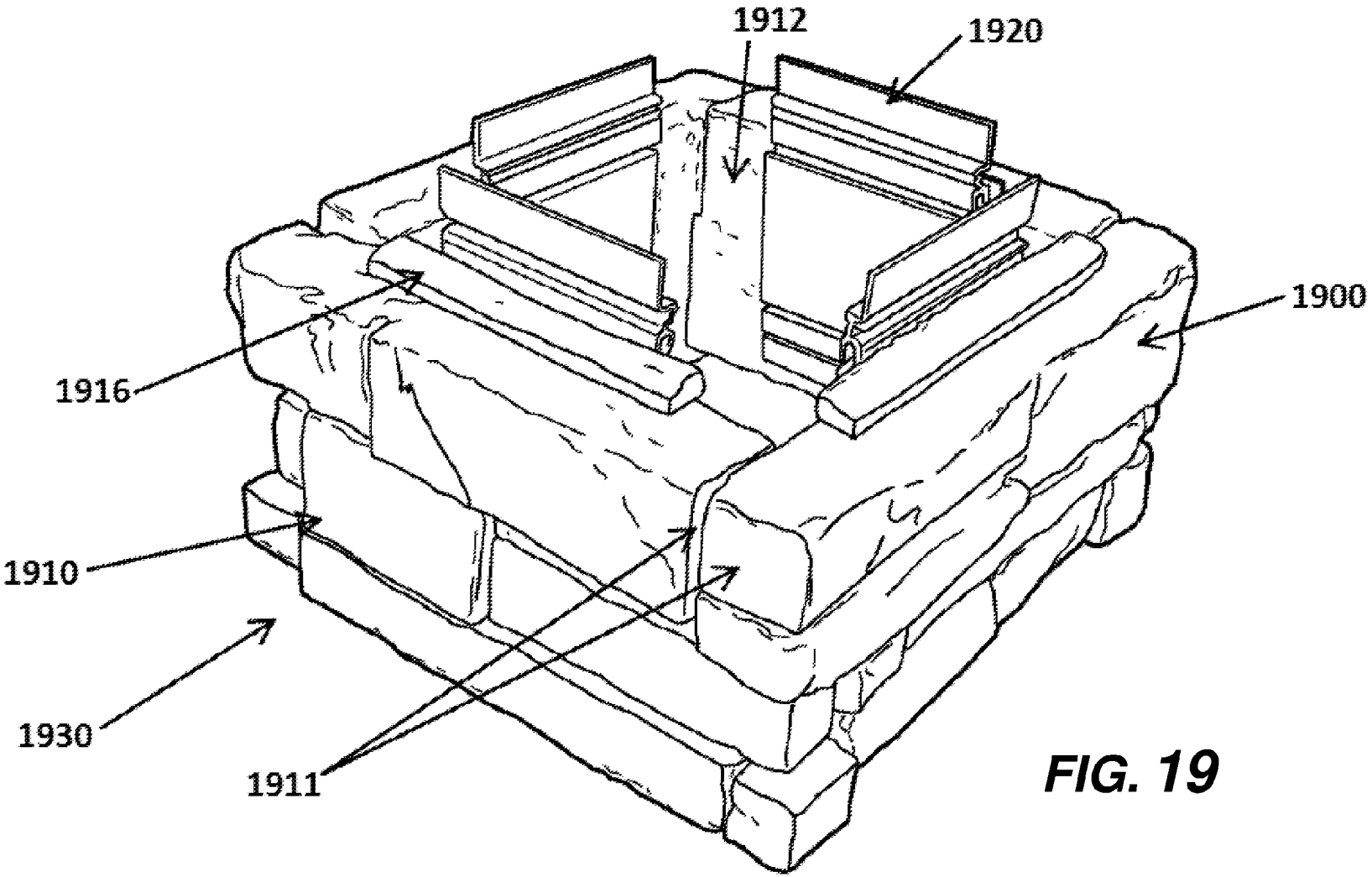
FIG. 19 is a representative post veneer system according to the invention, which provides for seamless corners around the post being covered by the panel veneer system.

FIG. 19 shows a perspective view of a 4-panel system for covering the sides of a post that employs the inventive universal suspension rails. As shown, rows of four panels around the circumference of the post can be arranged and stacked on top of previous rows until a desired amount of the post is covered. More specifically, four specifically shaped panels can be installed along four corresponding faces of a post. The four panel pieces are configured to cooperate with one another to interlock around the circumference of the post. Here, a cross section of the post is square, but any shape post can be used and appropriate sized panels selected for a particular design. The outline of the face of the panel pieces is preferably shaped in the form of a concave rectilinear polygon. In this manner the panels fit together like puzzle pieces so that the outline of each panel is difficult to determine upon visual inspection of the installed facade. Further camouflaging the joints between panels is the stacked stone appearance of the face of the panel. Due to the panel being divided up to look like a collection of several smaller stones, it is difficult to determine where the outline of the panel starts and stops. No other existing modular facade system provides this benefit.

Figure 20A:
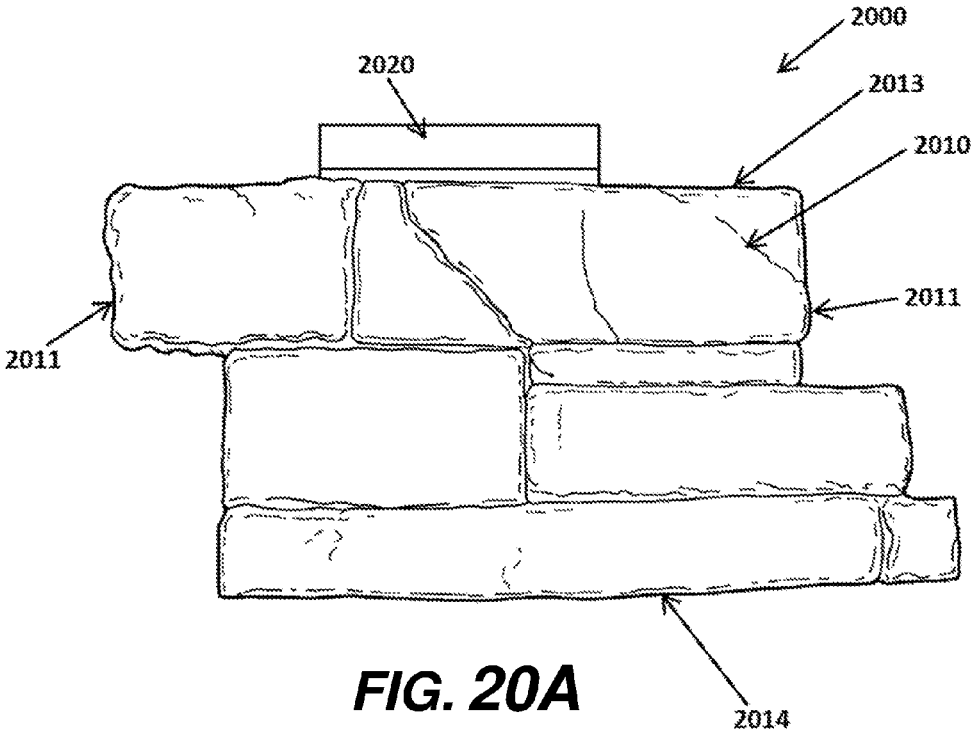
FIGS. 20A-B are front and back perspective views, respectively, of a representative panel embodiment of the system illustrated in FIG. 19.
Figure 20B:
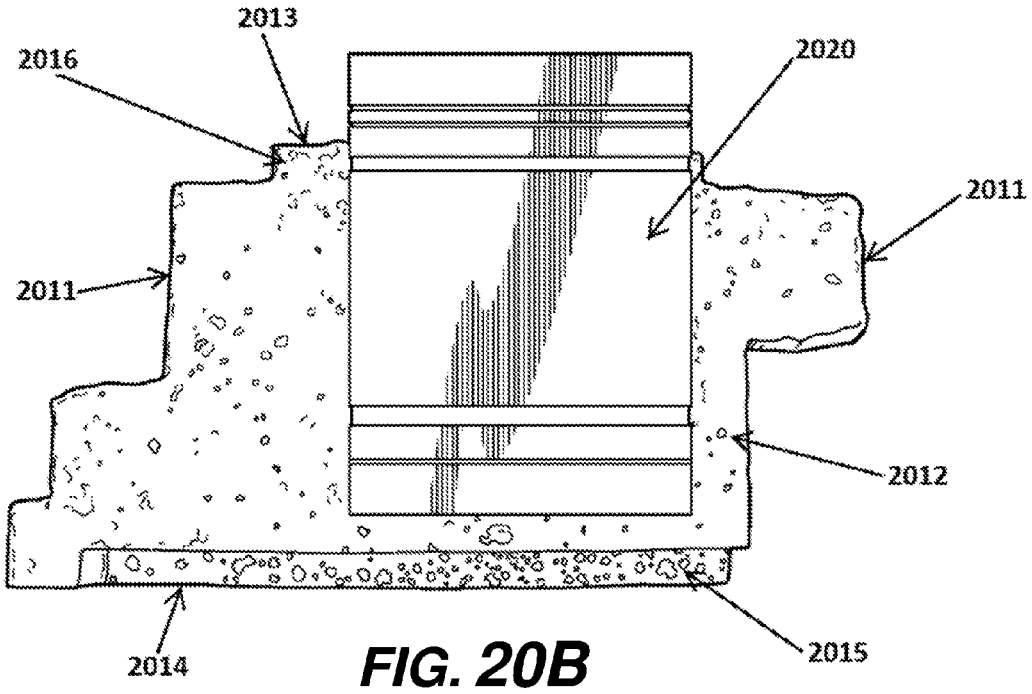

As shown in FIG. 19 and FIGS. 20A-B, on the interior face 1912, 2012 of each panel 1900, 2000 (back side or side installed on post) there is provided a hanger or bracket according to the invention. Any of the universal suspension rails 1920, 2020 described in this specification can be used. The hanger or rail is preferably a single piece and universal that can be incorporated into the panel during manufacture of the panel or attached to the panel prior to installation. Alternatively, no brackets can be used and the panels can be installed on a post or wall corner using mortar. As shown, the hanger extends an amount above the panel in which it is embedded to provide for interlocking of the panels in the system by providing a surface for engaging with the hanger of another panel disposed on top. In this manner, each panel can be secured into the system by interlocking with a panel above and below. The bottom-most panel can be secured onto the post initially with a securing rail that provides an engagement surface for that panel's hanger. Alternatively or in addition, as with any embodiment of the invention, mortar, adhesive, or other securing means such as screws can be used. In preferred embodiments, a v-shaped groove is provided in which screws can be inserted at any point along the length of the suspension rail for hanging the bracket and panel to a surface. The v-shaped groove can further comprise structure (such as a groove) for supporting the head of screws and maintaining the screws in a certain position within the v-shaped receiving groove.

As shown, the finished product is especially advantageous because the modular nature of the system is not readily apparent. It has been found that panels comprising three or more "stones" on the face and where some of the stones are in a staggered configuration to one another provide a visually pleasing veneer system in that the outline of each panel is difficult if not impossible to detect by passersby.

Panels for providing a veneer to posts and columns according to the invention need not be of any specific shape or size and such will depend greatly on the particular application for which the panels are used. For example, when covering a post that is 4-inches square, the panels should be greater than 4-inches wide, such that the entire face of each side of the post may be completely covered by a panel. Further, it is preferred that each panel have finished "stone" that is visible from more than one side of the post. Especially preferred are panels that are visible from three sides of the post.

As shown in FIG. 19 the four panels constituting one row around the post have a specific interlocking configuration. Though the panels may differ in shape, each panel has three faces, such that the panel can be seen on three sides of a finished post, or in three of the facades of the post. More particularly, as shown in FIGS. 19 and 20, when installed as a veneer to a post, each panel has a first main face 1910, 2010 and two minor faces 1911, 2011. The main face 1910,

2010 of the panel constitutes the majority of the surface area of one side of the post, while the two minor faces 1911, 2011 protrude into the surface area of a panel on adjacent sides of the post, such as the left and right sides 1911, 2011 of the post. In this manner, the individual panels of the finished post veneer system cannot be detected upon mere visual inspection. Such a panel system 1930 differs from existing modular corner covering systems in that each panel 1900, 2000 has an overall block or brick shape as opposed to the typical L shaped configuration, which allows for the panel to be seen on another side of the post or corner joint of two walls. L-shaped panels are difficult to manufacture and are susceptible to breakage during shipping, installation, or other handling of the panel pieces due to their awkward, non-stackable shape. In contrast, panels of the invention can easily be stacked prior to shipping or installation. No other existing panel system comprises substantially planar panels with three faces that can be used for covering a flat wall surface, a concave corner surface, and a convex corner surface. Existing corner covering systems comprise a combination of planar panels and a variety of L shaped panels to accomplish this goal. In contrast, the panels of the invention are universal in that they can be used to cover any surface.

Provided in FIGS. 20A-B is a first panel 2000 of the panel veneer system for covering posts according to an embodiment of the invention. Respectively, are front and back schematic diagrams of the proximal panel shown in FIG. 19. This proximal panel shows "stones" formed on the face of the panel in a staggered or offset configuration and stacked at least 3-4 stones high and at least 2 stones wide. The outline of the panel face is generally a z-shape polygon to provide three finished faces to the panel, a configuration that fits with other specifically shaped pieces, namely the t shaped and inverted t-shaped panels, and to hide the overall outline of the panel when installed in the system. The stones can be molded or carved into the panel and as such are not actually discrete stones but merely give the appearance of being discrete stones. Panels 2000 can also comprise a collection of discrete stones joined together by mortar or an adhesive, but such embodiments may have a reduced strength and are more complex from a manufacturing perspective and so are less preferred. Any number of "stones" or formations in the panel giving the appearance of individual dry stacked stones or individual stones joined together with mortar can be used. If the panel constitutes one stone, then it will be easier for observers of the facade to detect the outline of the individual panels and to identify the work as a modular system instead of the more desirable conventional brick and mortar look.

It has been found that panels 2000 comprising the formation of a plurality of stones with at least two stones disposed in an offset manner relative to one another are preferred. For example, the panels can comprise only two stones, where the stones are stacked on top of one another in an offset manner. In such a configuration the panel is said to comprise two stones high and one stone wide. Further preferred are panels with at least three stones stacked high, wherein at least one of the stones is offset from another. What is meant by "offset" in the context of this specification is that where two stones abut, the abutting edge of at least one of the stones is not fully abutted by the abutting edge of the other stone. For example, an offset configuration can simply be achieved by having one stone with a first length and a second stone with a smaller length stacked immediately above or below the first, such that the longitudinal edges of the smaller stone do not line up with the longitudinal edges of the larger stone.

Another feature of embodiments of the invention is a modular facade panel comprising a front face 1910, 2010 formed as a plurality of stacked stones and a back side comprising a suspension rail, wherein an outline of the front face is a concave rectilinear polygon. Panels with this shape render the panel universal for any surface due to having three finished sides. As shown in FIGS. 20A-B, the left and right edges 2011 of the facade panel 2000 are staggered or offset to allow for the stones of this panel to protrude into the face of the facade on the left and right sides of the post or wall to which the panels are attached. In this manner, it is difficult to detect where the outline of each panel is thereby minimizing any negative aesthetic impact produced by the system upon installation. This configuration also allows for greater security of the panels within the system, as there are additional surfaces for engaging surfaces of other panels of the system to prevent movement of the panels once installed. These panels are universal in that they can be used to cover the planar surface of a wall whether or not a corner is being covered. Additionally, the panels can be applied to 90 degree corners (concave) or 270 degree corners (convex), without the need for special corner-specific panel pieces in the facade system.

As shown, each panel 2000 in the system can also have a stepped configuration for providing additional engagement surfaces for securing the panels in the system. FIGS. 20B shows a recessed surface 2015 along most of the length of the bottom side 2014 of the back of the panel. The recess 2015 of this panel 2000 can then be positioned in the system above a panel having a corresponding protrusion 2016 along its top edge 2013, as shown in FIG. 20A. (A similar protrusion 1916 is also shown in FIG. 19.) As shown in FIG. 20A, this first panel also has a protrusion 2016 on the top edge 2013 of the panel 2000, which can be interlocked with a corresponding recess 2015 of another panel disposed above this panel. The protrusions 2016 of the system can be the same height and length for each panel 2000 and the recesses 2015 can be the same height and depth for each panel 2000 so that any panel can be placed on top of any other panel in the system. The recesses 2015 and protrusions 2016 can be made to fit specific panels to ensure that a panel is not placed on top of an identical panel to ensure the individual panels remain undetected once installed in a system.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. In particular, embodiments may include suspension rails where features from one type of suspension rail are interchangeable or substitutable with features from another type of suspension rail and vice versa, include those embodiments not explicitly recited herein. Where a range of values is provided in this specification, each value between the upper and lower limits of that range is also specifically disclosed. The upper and lower limits of these smaller ranges may independently be included or excluded in the range as well. As used in this specification, the singular forms "a," "an," and "the" include plural referents unless the context clearly dictates otherwise. It is intended that the specification and examples be considered as exemplary in nature and that variations that do not depart from the essence of the invention are intended to be within the scope of the invention. Further, the references cited in this disclosure are incorporated by reference herein in their entireties.

The invention claimed is:

1. A suspension rail comprising:

a first support member with a first perimeter defined by a plurality of sides;

wherein the first support member comprises multiple cross bars disposed in an X configuration and extending between two sides of the first support member;

a second support member with a second perimeter smaller than the first perimeter;

a plurality of third support members in direct communication with and extending between and connecting the first support member and the second support member;

wherein two elongated sides of the first support member are configured for connecting the first support member to a surface.

2. The suspension rail of claim 1, wherein the sides of the first support member have a width greater than their thickness and the sides of the second support member have a thickness greater than their width.

3. The suspension rail of claim 1, wherein the first support member comprises an upper tab in direct communication with the first support member but not the second support member.

4. The suspension rail of claim 1, further comprising one or more aligning tabs disposed perpendicular to and along an edge of one or more sides of the first support member.

5. The suspension rail of claim 1, wherein one or more of the cross bars is disposed perpendicular to any of the sides of the first support member.

6. The suspension rail of claim 1, wherein one or more of the cross bars is fortified with a perpendicular support extending along a length of the cross bar.

7. The suspension rail of claim 1, wherein the first support member comprises a tab configured for securing the first support member to a surface, which tab is disposed along the length of one side of, and in a stepped configuration relative to, the first support member.

8. A suspension rail comprising:

a first support member with a planar face having a first support member perimeter and cross bars disposed in an X configuration;

a second support member disposed a distance from the first support member;

a plurality of third support members disposed perpendicular to and connecting the first support member and the second support member; and a planar tab disposed in a stepped configuration relative to the planar face of the first support member, such that an outline of the planar tab and the first support member together is larger than the perimeter of the first support member alone.

9. The suspension rail of claim 8, wherein the first support member and the second support members are configured as four-sided frames.

10. The suspension rail of claim 8, wherein the perimeter of the first support member is larger than a perimeter of the second support member.

11. The suspension rail of claim 8, wherein the second support member is disposed parallel to the first support member.

12. The suspension rail of claim 8, wherein the plurality of third support members are disposed perpendicular to the first support member and the second support member.

13. The suspension rail of claim 8, further comprising one or more side tabs disposed perpendicular to one or more sides of the first support member.

* * * * *